US009689163B2

(12) United States Patent
Green et al.

(10) Patent No.: US 9,689,163 B2
(45) Date of Patent: Jun. 27, 2017

(54) TAPERED TRUSS

(71) Applicant: Morton Building, Inc., Morton, IL (US)

(72) Inventors: Wayne Green, Newark, OH (US); Walter Green, Fredericktown, OH (US); Clarence Green, Newark, OH (US); David Derwacter, Zanesville, OH (US); Chester Prinkey, Utica, OH (US); Darren Skeese, Nashport, OH (US); Daniel West, Newark, OH (US)

( * ) Notice: Subject to any disclaimer, the term of this patent is extended or adjusted under 35 U.S.C. 154(b) by 0 days.

(21) Appl. No.: 14/936,399

(22) Filed: Nov. 9, 2015

(65) Prior Publication Data

US 2016/0060867 A1 Mar. 3, 2016

Related U.S. Application Data

(63) Continuation of application No. 14/169,155, filed on Jan. 31, 2014, now Pat. No. 9,181,700, which is a (Continued)

(51) Int. Cl.
*E04C 3/11* (2006.01)
*E04B 1/18* (2006.01)
(Continued)

(52) U.S. Cl.
CPC ..... *E04C 3/11* (2013.01); *E04B 1/18* (2013.01); *E04B 7/026* (2013.01); *E04C 3/06* (2013.01);
(Continued)

(58) Field of Classification Search
CPC ..... E04C 3/17; E04C 3/11; E04C 3/16; E04C 3/08; E04B 7/022; E04B 1/18;
(Continued)

(56) References Cited

U.S. PATENT DOCUMENTS 1,258,408 A 3/1918 Hill
1,336,324 A 4/1920 Waern
(Continued)

FOREIGN PATENT DOCUMENTS

EP 0095614 A1 12/1983
JP 06158874 A 6/1994
WO 8304064 A1 11/1983

*Primary Examiner* — Robert Canfield
*Assistant Examiner* — Matthew Gitlin
(74) *Attorney, Agent, or Firm* — Benesch Friedlander Coplan & Aronoff LLP; Benjamen E. Kern; Thomas Y. Kendrick

(57) ABSTRACT

A tapered truss is provided. In one embodiment, the truss has a pair of base members configured to be attached to a top surface of a vertical support member. The truss may further have an upper pair of truss members and a lower pair of truss members. Each upper truss member each forms an acute angle with a respective base member and each lower truss member forms an obtuse angle from the respective base member such that the lower truss member is not parallel to the upper truss member. The truss may additionally include a ceiling joist member connected to each of the lower truss members. In one embodiment, the ceiling joist member is substantially parallel to the pair of base members.

20 Claims, 18 Drawing Sheets

Related U.S. Application Data continuation of application No. 13/164,718, filed on Jun. 20, 2011, now Pat. No. 8,671,642, which is a continuation-in-part of application No. 11/627,947, filed on Jan. 26, 2007, now abandoned.

(51) Int. Cl.

| | |
|---|---|
| ***E04C 3/17*** | (2006.01) |
| ***E04C 3/40*** | (2006.01) |
| ***E04C 3/42*** | (2006.01) |
| ***E04C 3/08*** | (2006.01) |
| ***E04B 7/02*** | (2006.01) |
| ***E04C 3/06*** | (2006.01) |
| *E04B 1/24* | (2006.01) |
| *E04C 3/04* | (2006.01) |

(52) U.S. Cl.

CPC ..... *E04C 3/08* (2013.01); *E04C 3/17* (2013.01); *E04C 3/40* (2013.01); *E04C 3/42* (2013.01); *E04B 2001/249* (2013.01); *E04B 2001/2415* (2013.01); *E04B 2001/2445* (2013.01); *E04C 2003/0486* (2013.01)

(58) Field of Classification Search

CPC ..... E04B 2001/2415; E04B 2001/2445; E04B 2001/2457; E04B 2001/246; E04B 2001/249; E04B 2001/2493

USPC ... 52/633, 634, 636, 638, 639, 650.1, 650.2, 52/651.06, 657, 643, 90.1, 690, 691, 696, 52/837, 92.1, 92.2, 93.1, 93.2

See application file for complete search history.

(56) References Cited

U.S. PATENT DOCUMENTS

| | | | | |
|---|---|---|---|---|
| 1,342,021 | A | 6/1920 | Jennings | |
| 1,774,286 | A | 8/1930 | Moss | |
| 1,775,572 | A | 9/1930 | Ross | |
| 2,461,916 | A | 2/1949 | Goicoechea | |
| 2,764,107 | A | 9/1956 | Niswonger et al. | |
| 3,224,151 | A | 12/1965 | Nystrom | |
| 3,526,068 | A | 9/1970 | Buxton | |
| 4,030,256 | A | 6/1977 | Ollman | |
| 4,120,065 | A | 10/1978 | Sivachenko et al. | |
| 4,187,652 | A | 2/1980 | Bobrovnikov et al. | |
| 4,516,363 | A | 5/1985 | Beaulieu et al. | |
| 4,858,398 | A | 8/1989 | Ricchini | |
| 4,894,964 | A | 1/1990 | Thrift et al. | |
| 4,965,740 | A | 10/1990 | Schofield et al. | |
| 4,974,387 | A | 12/1990 | Dufour | |
| 4,982,545 | A | 1/1991 | Stromback | |
| 5,311,708 | A | 5/1994 | Frye | |
| 5,341,611 | A | 8/1994 | Lewis | |
| 5,457,927 | A | 10/1995 | Pellock et al. | |
| 5,901,522 | A | 5/1999 | Slater | |
| 6,052,953 | A | 4/2000 | Jewell | |
| 6,088,988 | A | 7/2000 | Sahramaa | |
| 6,318,043 | B1 | 11/2001 | Johnson | |
| 6,438,920 | B1 | 8/2002 | Tobey et al. | |
| 6,470,632 | B1 | 10/2002 | Smith | |
| 6,481,176 | B2 | 11/2002 | Snow | |
| 6,643,981 | B2 | 11/2003 | Pina et al. | |
| 6,691,488 | B2 | 2/2004 | Branson | |
| 6,742,310 | B1 | 6/2004 | Weeks | |
| 6,840,015 | B1 | 1/2005 | Ashley | |
| 7,325,362 | B1 | 2/2008 | Rowland | |
| 8,695,295 | B2 * | 4/2014 | Thornton | E04C 3/14 446/106 |
| 9,038,347 | B2 * | 5/2015 | Gundersen | E04B 1/30 52/636 |
| 2001/0015047 | A1 | 8/2001 | Branson | |
| 2002/0139079 | A1 | 10/2002 | Brady | |
| 2003/0154685 | A1 | 8/2003 | Williams | |
| 2003/0159369 | A1 | 8/2003 | Hoehn | |
| 2004/0194412 | A1 | 10/2004 | Sandoz | |
| 2005/0005537 | A1 | 1/2005 | Houk, Jr. | |
| 2006/0123733 | A1 | 6/2006 | Moody et al. | |
| 2010/0043341 | A1 | 2/2010 | Staley | |
| 2010/0326005 | A1 | 12/2010 | Jones, III et al. | |
| 2014/0260024 | A1 | 9/2014 | Tate | |
| 2015/0225956 | A1 * | 8/2015 | Gundersen | E04B 1/30 52/636 |

* cited by examiner

Figure 18
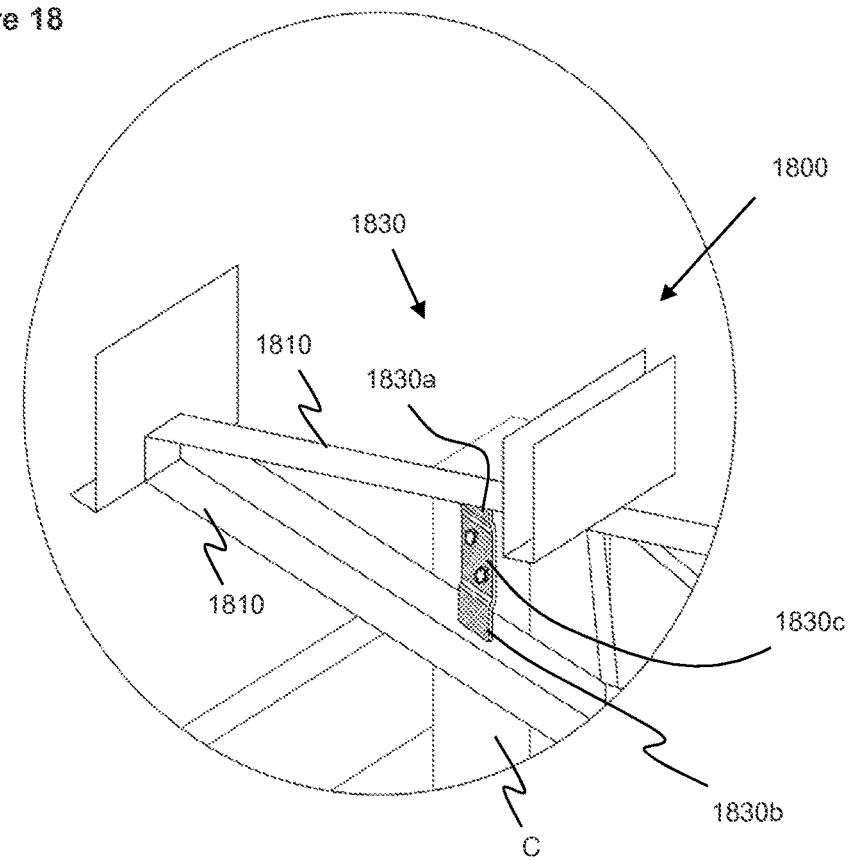
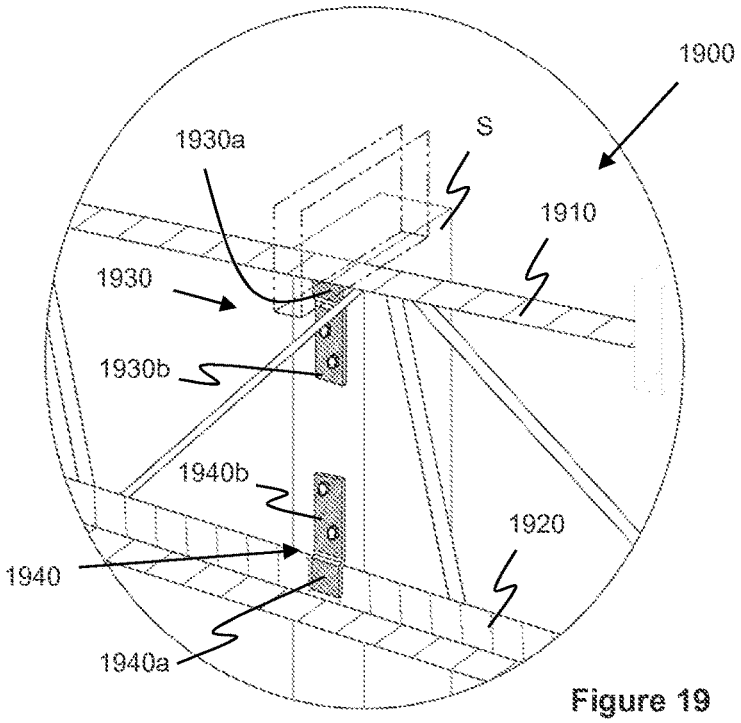
Figure 19

TAPERED TRUSS

FIELD OF INVENTION

The present application relates to a roof truss structure. More particularly, the application relates to a tapered roof truss structure.

BACKGROUND

A variety of truss constructions are known in the art for roof support in wide-span buildings. In one known prior art embodiment, a moment connection exists between the truss and its supporting columns or walls. This moment connection causes right-left compression and an associated reaction at the base of each column or wall, which is known as horizontal reaction. A horizontal reaction will occur at the bottom of a vertical column whenever the top of such column is exposed to a non-vertical or angular moment, generally known as a bending moment. In the field of wide-span construction, the accepted consequence of the presence of a horizontal reaction is that large supports are required to buttress the base of each vertical column or wall against the forces of the horizontal reaction.

BRIEF DESCRIPTION OF DRAWINGS

The accompanying drawings, together with the detailed description provided below, describe exemplary embodiments of the claimed invention. Like elements are identified with the same reference numerals. The drawings are not to scale and the proportion of certain elements may be exaggerated for the purpose of illustration.

FIG. 18 illustrates a perspective view of a connection between a truss and a support member defining an eave portion of an end wall;

FIG. 19 illustrates a perspective view of a connection between a truss and a support member defining an end wall, spaced away from the eave;

DETAILED DESCRIPTION

Figure 1:
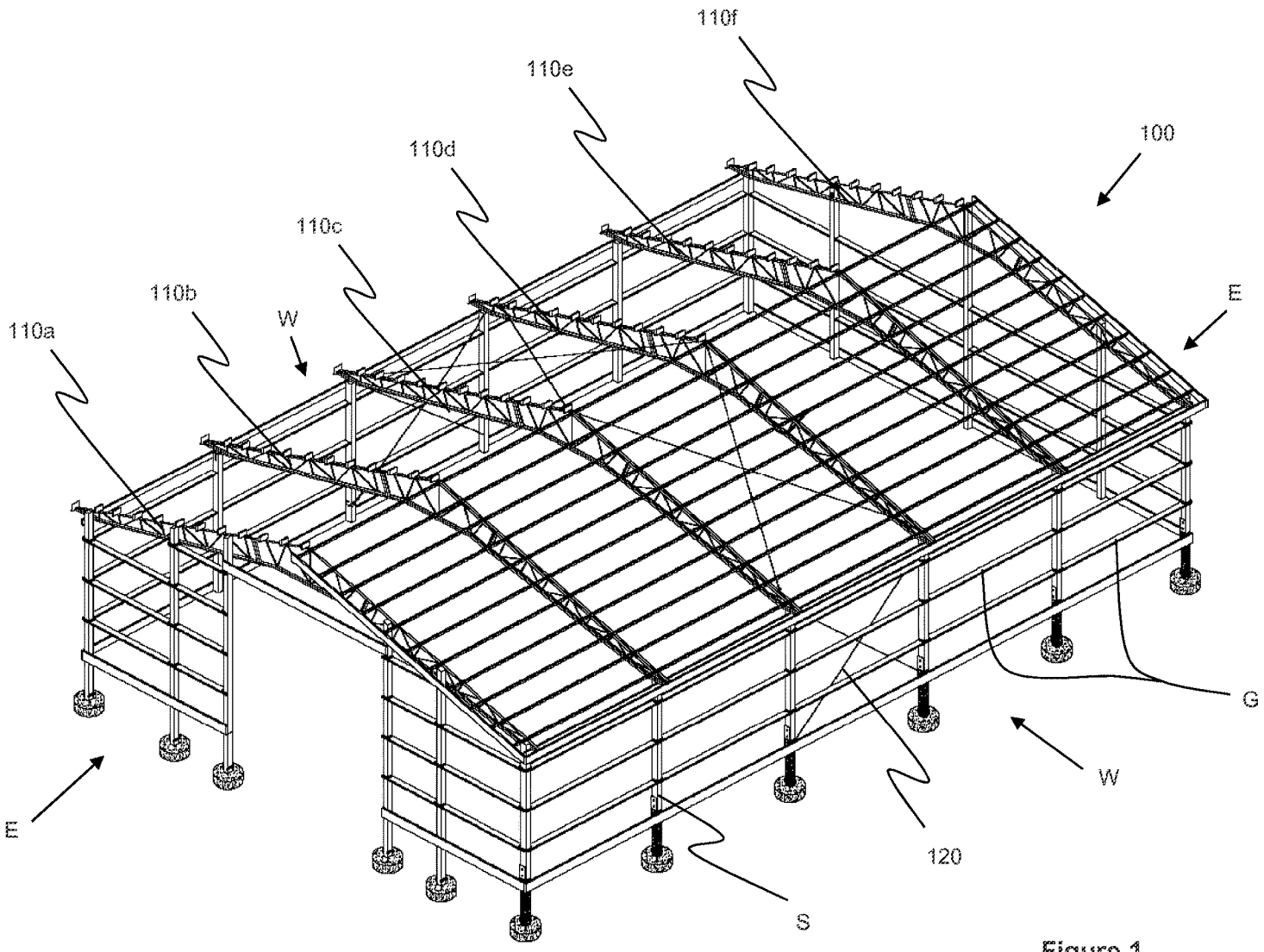
FIG. 1 illustrates a perspective view of a structure employing a plurality of tapered trusses.

FIG. 1 illustrates a perspective view of a structure 100 employing a plurality of tapered trusses 110*a-f*. In the illustrated embodiment, the trusses 110*a-f* are attached to a plurality of support members S. In the illustrated embodiment, the support members are columns constructed of steel, wood, concrete, a polymeric material, other known construction materials, or a combination thereof. In an alternative embodiment (not shown), the support members are solid walls. It should be understood that the number of trusses and support members employed in the structure 100 may vary according to the size of the structure.

In one embodiment, the tapered trusses 110*a-f* are all configured to be attached to top surfaces of the respective support members S. In another embodiment, the tapered trusses that define the end walls E of the structure (illustrated here as tapered truss 110*a* and tapered truss 1101) are attached to a side surface of the associated support members S, while the tapered trusses that are spaced away from the end walls E (illustrated here as tapered truss 110*b*, tapered truss 110*c*, tapered truss 110*d*, and tapered truss 110*e*) are attached to the top surfaces of the associated support members S. In one embodiment, tapered trusses 110*a-f* have a length of up to 150 ft. In another embodiment, tapered trusses 110*a-f* have a length between about 20 ft. and about 150 ft. In another embodiment, tapered trusses 110*a-f* comprise two truss portions, each of which is between about 10 ft. and about 75 ft. in length. In another embodiment, tapered trusses 110*a-f* have a length of 24 ft., 30 ft., 36 ft., 40 ft., 50 ft., 60 ft., 70 ft., 80 ft., 90 ft., 100 ft., 115 ft., 125 ft., or 150 ft. In one embodiment, tapered trusses 110*a-f* are supported exclusively by support members S and include no intermediary support members between support members S. In one embodiment, tapered trusses 110*a-f* are attached to the respective support members S and spaced approximately 16 ft. apart when measured from the center of a first tapered truss to the center of an immediately adjacent tapered truss. In another embodiment, tapered trusses 110*a-f* are attached to the respective support members S and spaced approximately 12 ft. apart when measured from the center of a first tapered truss to the center of an immediately adjacent tapered truss. In still another embodiment, tapered trusses 110*a-f* are attached to the respective support members S and spaced between approximately 10 ft. apart and approximately 20 ft. apart, when measured from the center of a first tapered truss to the center of an immediately adjacent tapered truss.

With continued reference to FIG. 1, the structure 100 includes a plurality of girts G attached to the support members S, thereby providing a frame to define a first and second end wall E and a first and second sidewall W. The structure 100 further includes a plurality of X-braces 120 configured to provide additional support for the frame.

While the illustrated embodiment shows one X-brace 120 disposed on each sidewall W, and a pair of X-braces disposed along a roof portion of the structure 100, it should be understood that any number of X-braces may be employed.

Figure 2:
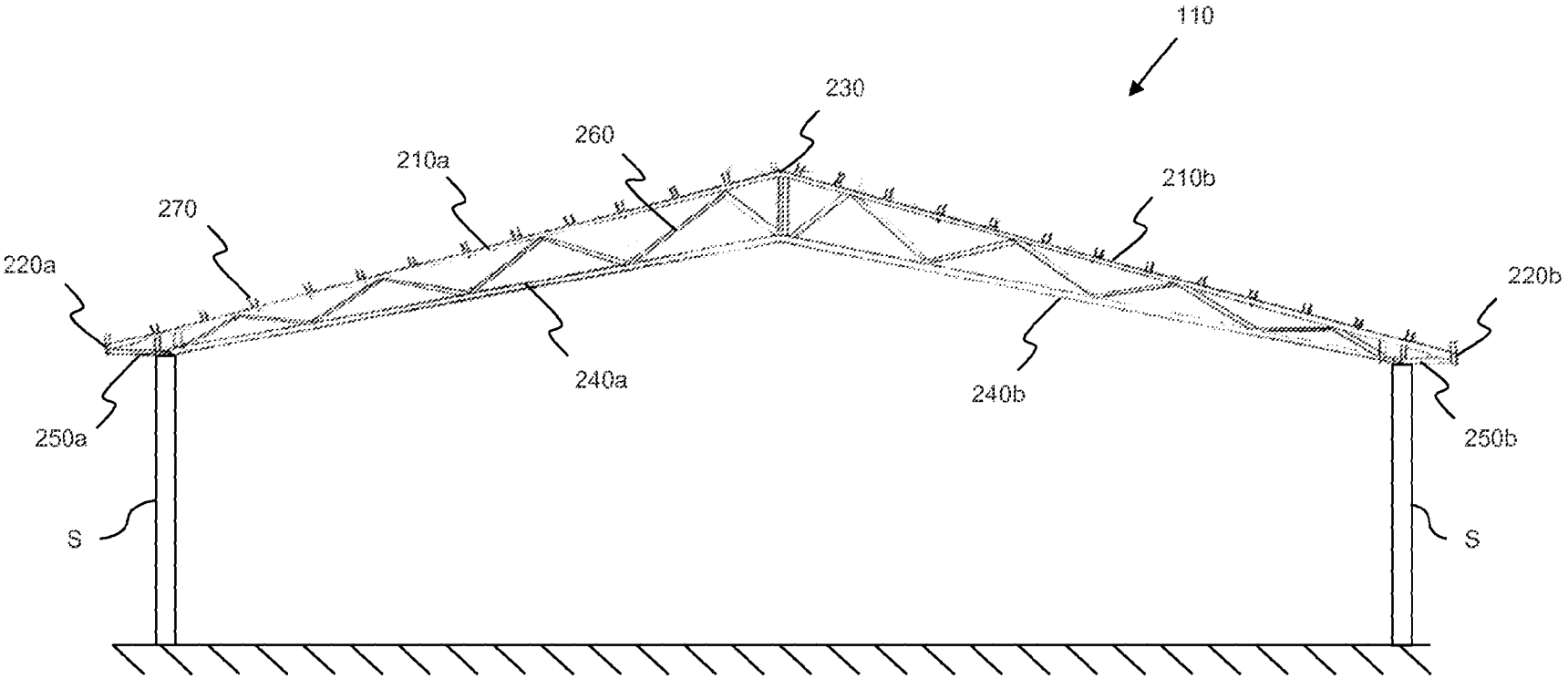
FIG. 2 illustrates a front view of one embodiment of a tapered truss on support members.

FIG. 2 illustrates a front view of one embodiment of a tapered roof truss 110 on support members S. In the illustrated embodiment, the tapered truss 110 includes upper truss members, illustrated in FIG. 2 as a first outer rafter chord 210*a* and a second outer rafter chord 210*b*. The first and second outer rafter chords 210*a,b* are sloped to define a roof having eaves 220*a,b* and a central ridge 230. In the illustrated embodiment, each outer rafter chord 210*a,b* is a single, elongated beam or rod. In an alternative embodiment (not shown), the upper truss members may include a plurality of components.

The tapered truss 110 further includes lower truss members, illustrated in FIG. 2 as a first inner rafter chord 240*a* and a second inner rafter chord 240*b*. Each inner rafter chord 240*a,b* is a single, elongated beam or rod. In an alternative embodiment (not shown), the lower truss members may include a plurality of components.

The tapered truss 110 further includes base members, illustrated in FIG. 2 as a first horizontal base chord 250*a* and a second horizontal base chord 250*b*. It should be understood that the outer rafter chords 210*a,b*, inner rafter chords 240*a,b*, and horizontal base chords 250*a,b* are all coplanar, as can be seen in FIG. 1. In the illustrated embodiment, each horizontal base chord 250*a,b* is a single, elongated beam or rod. In an alternative embodiment (not shown), the base members may include a plurality of components.

In one embodiment, each outer rafter chord 210*a,b*, each inner rafter chord 240*a,b*, and each horizontal base chord 250*a,b* is constructed of steel and has an I-beam configuration. In alternative embodiments, at least one of the outer rafter chords 210*a,b*, inner rafter chords 240*a,b*, and horizontal base chords 250*a,b* may be constructed of other metal, wood, a polymeric material, or other known construction materials. Further, in alternative embodiments at least one of the outer rafter chords 210*a,b*, inner rafter chords 240*a,b*, and horizontal base chords 250*a,b* may have cross-sections that are L-shaped, C-shaped, T-shaped, square, rectangular, circular, oval, or any other regular or irregular polygonal shape.

With continued reference to FIG. 2, the bottom of each horizontal base chord 250*a,b* is connected to the top surface of a support member S. In one embodiment, each horizontal base chord 250*a,b* is welded or attached to its respective support member S via fasteners. Exemplary fasteners include rivets, bolts, screws, nails, pins, and other known fasteners. In an alternative embodiment, the base chords 250*a,b* simply rest on the support members S.

In one embodiment, the upper truss members and lower truss members are joined by a webbing, illustrated in FIG. 2 as a plurality of beams 260. The beams 260 are attached to the outer rafters 210*a,b* and inner rafters 240*a,b* to form a series of triangles or other geometric shapes. In one embodiment, the horizontal base chords 250*a,b* are also joined to outer rafters 210*a,b* by beams 260. In the illustrated embodiment, the beams 260 are directly attached to the outer rafters 210*a,b*, inner rafters 240*a,b*, and horizontal base chords 250*a,b*. The beams 260 may be welded or attached via fasteners. Exemplary fasteners include rivets, bolts, screws, nails, pins, and other known fasteners. In an alternative embodiment (not shown), the beams are attached via junction plates, brace plates, or other known connectors. In another alternative embodiment (not shown), the truss 110 is solid and the outer rafters 210*a,b* and inner rafters 240*a,b* are joined by a solid sheet.

In one embodiment, the beams 260 are constructed of steel and have a rectangular cross-section. In alternative embodiments, the beams 260 may be constructed of other metals, wood, a polymeric material, or other known construction materials. Further, in alternative embodiments, the beams 260 may have cross-sections that are I-shaped, L-shaped, C-shaped, T-shaped, square, circular, oval, or any other regular or irregular polygonal shape.

With continued reference to FIG. 2, the tapered truss 110 further includes a plurality of retainers 270 configured to receive purlins for attaching a roof deck or sheathing. In an alternative embodiment (not shown), the tapered truss 110 does not include retainers 270 and the roof deck or sheathing is attached directly to the outer rafters 210*a,b*. In one embodiment, retainers 270 are configured such that they are spaced about 2 ft. apart, when measured from the center of a first retainer 270 to the center of an immediately adjacent retainer 270. In another embodiment, retainers 270 are configured such that they are spaced between 1 ft. and 4 ft. apart, when measured from the center of a first retainer 270 to the center of an immediately adjacent retainer 270. In yet another embodiment, retainers 270 are configured to receive purlins in the form of a dimensional 2 in. by 6 in. board. In still another embodiment, retainers 270 are configured to receive purlins in the form of a dimensional 2 in. by 4 in. board, or a dimensional 2 in. by 8 in. board.

Figure 3:
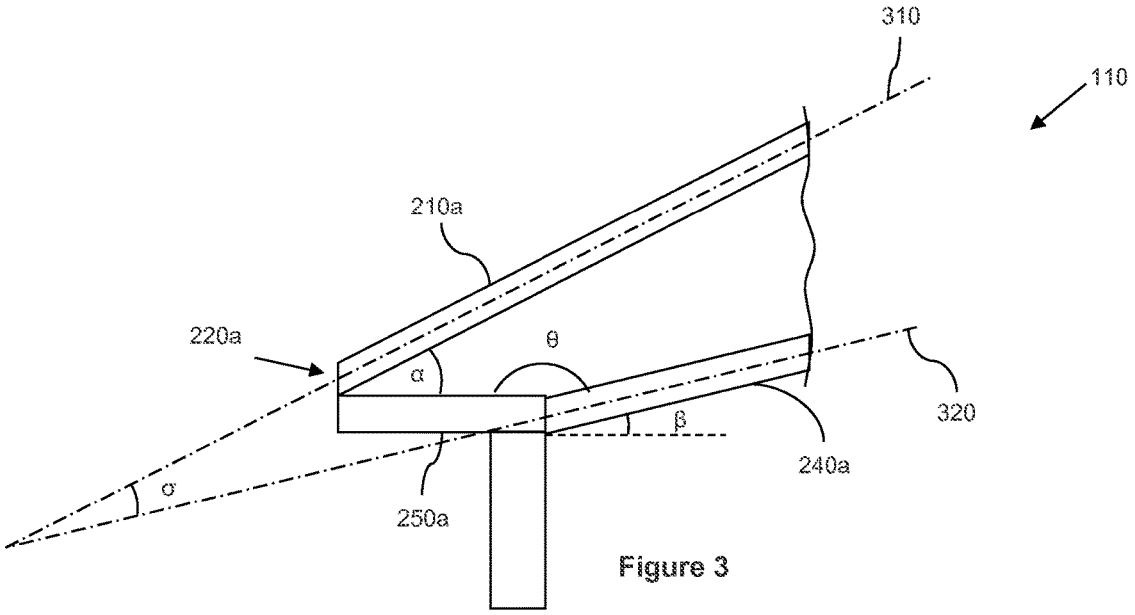
FIG. 3 illustrates a partial front view of an end portion of one embodiment of a tapered truss on support members.

FIG. 3 illustrates a partial front view of an end portion of one embodiment of a tapered truss 110. In the illustrated embodiment, an end of the first outer rafter 210*a* is connected to the horizontal base chord 250*a*, thereby defining a first eave 220*a*. The first outer rafter 210*a* and the horizontal base chord 250*a* form an acute angle $\alpha$. The slope of the first outer rafter 210*a* is equal to the acute angle $\alpha$. In one embodiment, the slope of the first outer rafter 210*a* is between about 2:12 to about 12:12. In another embodiment, the slope of the first outer rafter 210*a* is between about 4:12 and 6:12.

With continued reference to FIG. 3, an end of the first inner rafter 240*a* is connected to the horizontal base chord 250*a*, forming an obtuse inner angle $\theta$. The slope of the first inner rafter 240*a* is equal to the supplementary angle $\beta$ of the obtuse angle $\theta$. In the illustrated embodiment, the slope of the first inner rafter is less than the slope of the first outer rafter. In one embodiment, the slope of the first inner rafter 240*a* is about 1:12 to about 11:12. In another embodiment, the slope of the first inner rafter 240*a* is between about 1:12 and 5:12.

In the illustrated embodiment, the first outer rafter 210*a* has a longitudinal axis 310 and first inner rafter 240*a* has a longitudinal axis 320, wherein the longitudinal axes 310, 320 form an acute angle $\alpha$. In other words, the inner and outer rafters 210*a*, 240*a* are not parallel and the truss 110 has a tapered profile, as shown in FIG. 2. In the illustrated embodiment, the slopes of the inner and outer rafters 210*a*, 240*a* are constant from the support member S to the center ridge 230 of the truss 110. Therefore, no portion of the upper truss member is parallel to any portion of the lower truss member and the entire length of the truss 110 is tapered from the center ridge 230 to each of the eaves 220*a,b*. The tapered configuration of the truss 110 in combination with the placement of the truss on the top surface of the support members S results in a substantial reduction of a bending moment at the junction point and a corresponding reduction of right-left compression and horizontal reaction.

Figure 4:
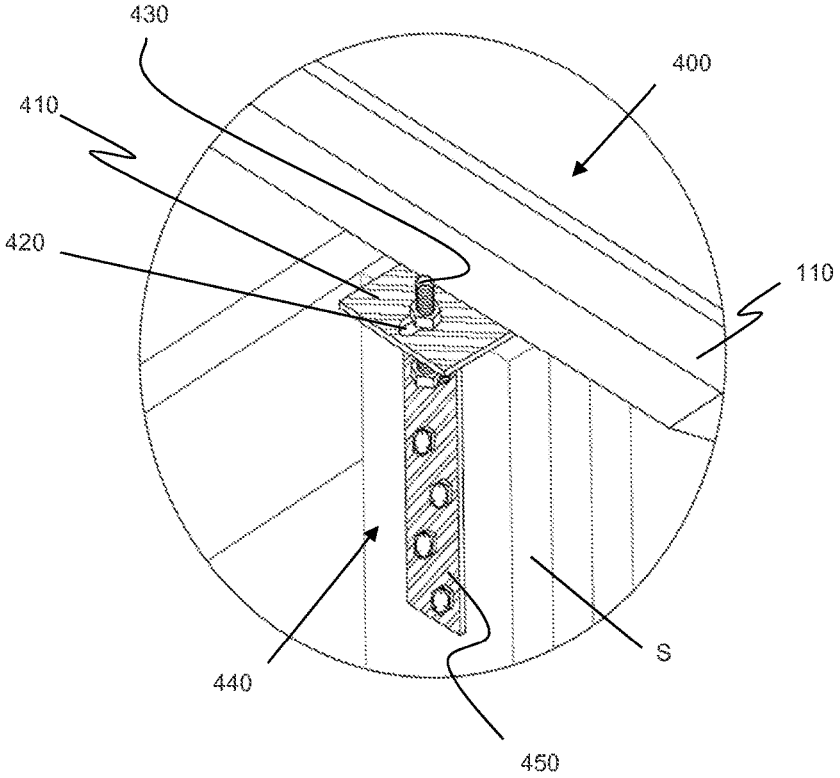
FIG. 4 illustrates a perspective view of one embodiment of a connection between a tapered truss and a support member.

FIG. 4 illustrates one embodiment of a bracket assembly 400 for connecting a tapered truss 110 to the top surface of a support member S. In the illustrated embodiment, the bracket assembly 400 includes a horizontal bracket 410 configured to be attached to the bottom of a tapered truss 110. The horizontal bracket 410 includes a slot 420 configured to receive a bolt 430 or other fastener. Exemplary fasteners include nails, screws, rivets, ties, pins, and other known fasteners. In one embodiment, the horizontal bracket 410 is welded to the bottom of the tapered truss 110. In an alternative embodiment, the horizontal bracket 410 is attached to the tapered truss 110 via one or more fasteners such as a bolt, screw, nail, rivet, tie, pin, or other known fastener. In one embodiment, bracket assembly 400 is at least substantially made of a metal material, such as steel.

With continued reference to FIG. 4, the bracket assembly 400 further includes an L-shaped bracket 440 having a major length 450 configured to be attached to the support member S, and a minor length (not shown) configured to be attached to a bottom surface of the horizontal bracket 410. In one embodiment, the minor length of the L-shaped bracket 440 has an aperture corresponding to the slot 420 of the horizontal bracket 410. The bolt 430 or other fastener is passed through the aperture of the minor length of the L-shaped bracket and through the slot 420 of the horizontal bracket 410, thereby fastening the horizontal bracket 410 to the L-shaped bracket 440.

In the illustrated embodiment, the major length 450 of the L-shaped bracket 440 is bolted to the support member S. In alternative embodiments (not shown), the major length 450 of the L-shaped bracket may be nailed, screwed, tied, or welded to the support member S, or it may be attached using other known methods of attachment.

Figure 5:
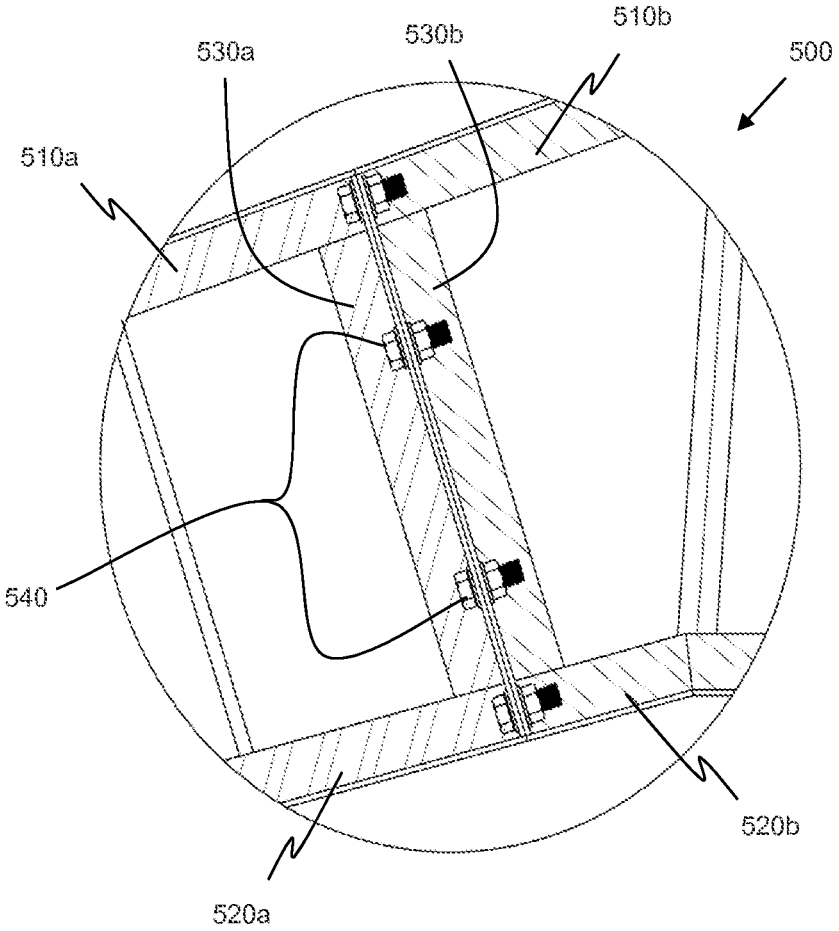
FIG. 5 illustrates a partial front view of a connection between two portions of a tapered truss.

FIG. 5 illustrates a partial front view of a connection between two portions of a tapered truss 500. In the illustrated embodiment, a first outer rafter 510*a* and a first inner rafter 520*a* are each connected to a first connection chord 530*a*. Further, a second outer rafter 510*b* and a second inner rafter 520*b* are each connected to a second connection chord 530*b*. The first connection chord 530*a* is attached to the second connection chord 530*b* via fasteners 540 to form the tapered truss 500. In the illustrated embodiment, the fasteners 540 are bolts. In alternative embodiments (not shown), other fasteners such as rivets, screws, nails, ties, or pins may be employed. In another alternative embodiment (not shown), the first connection chord 530*a* is welded to the second connection chord 530*b*.

In the illustrated embodiment, the first and second connection chords 530*a,b* help define first and second portions of the tapered truss 500. In one known method of making the tapered truss 500, the first and second portions of the tapered truss 500 are made separately at a manufacturing site, then transported to a construction site. In some instances, it is more convenient and/or less expensive to transport separate portions of a truss rather than a complete truss. The first and second portions are joined at the construction site by attaching the first connection chord 530*a* to the second connection chord 530*b* with fasteners 540. In an alternative embodiment, the first and second halves are joined at the construction site by welding the first connection chord 530*a* to the second connection chord 530*b*. In another alternative embodiment, in which the tapered truss is part of a temporary structure, the first and second halves are removably attached to each other at the construction site so that they may be later detached and transported to another location.

It should be understood that FIG. 5 illustrates a partial view of the truss 500 and only shows a first and second truss portion. As will be further discussed below, a truss may be constructed of a first half and second half, or it may include three or more truss portions.

Figure 6:
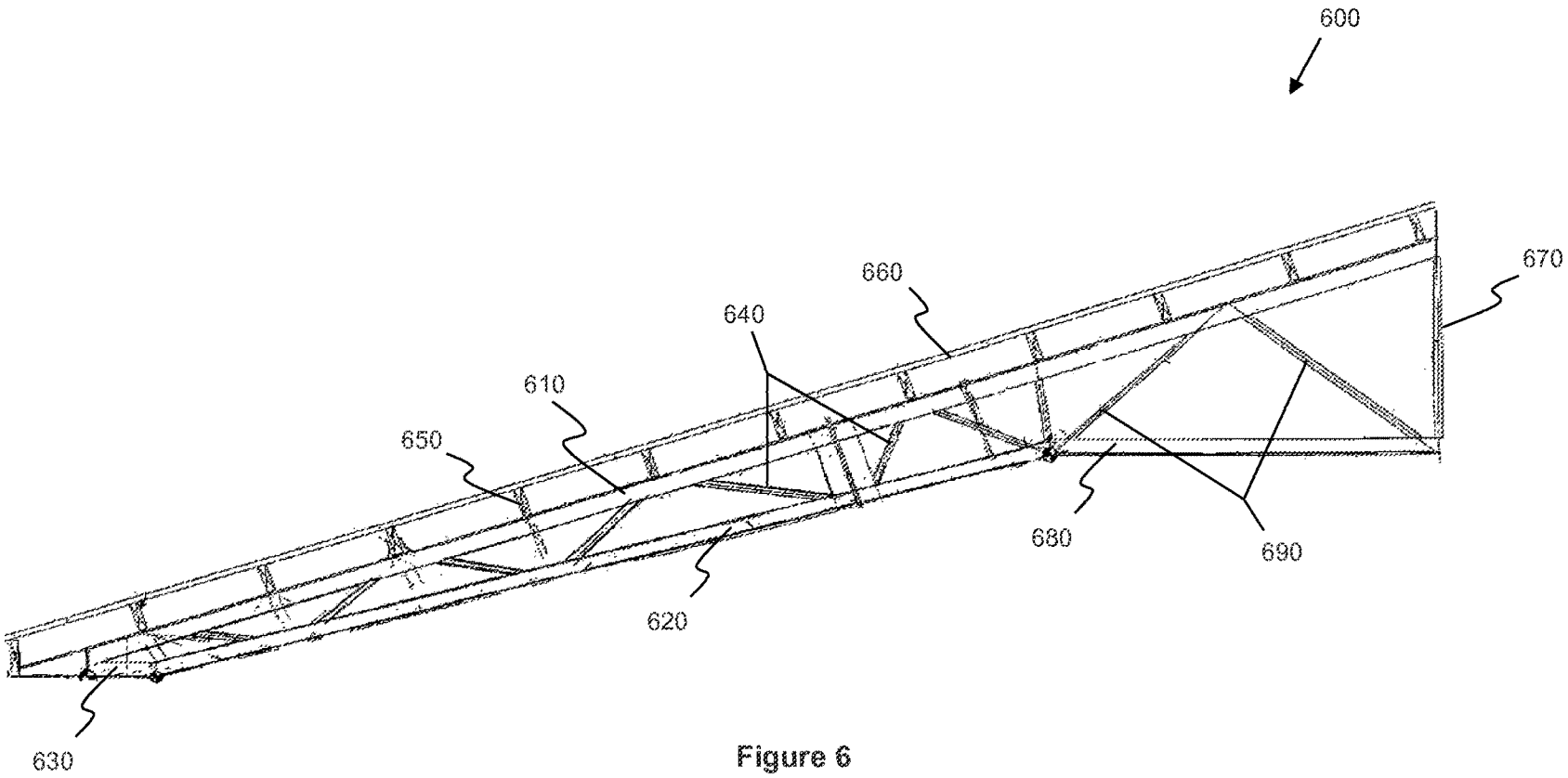
FIG. 6 illustrates a front view of a half section of an alternative embodiment of a tapered truss.

FIG. 6 illustrates a front view of an alternative embodiment of a half truss portion 600. The half truss portion 600 is configured to be attached to a complementary half truss portion (not shown). In the illustrated embodiment, the half truss portion 600 includes an upper truss member, illustrated in FIG. 6 as an outer rafter chord 610. The outer rafter chord 610 is sloped to define half of a roof having eaves and a central ridge. In the illustrated embodiment, the outer rafter chord 610 is a single, elongated beam or rod. In an alternative embodiment (not shown), the upper truss member may include a plurality of components.

The half truss portion 600 further includes a lower truss member, illustrated in FIG. 6 as an inner rafter chord 620. The inner rafter chord 620 is a single, elongated beam or rod. In an alternative embodiment (not shown), the lower truss member may include a plurality of components.

The half truss portion 600 further includes a base member, illustrated in FIG. 6 as a horizontal base chord 630. It should be understood that the outer rafter chord 610, inner rafter chords 620, and horizontal base chord 630 are all coplanar. In the illustrated embodiment, the horizontal base chord 630 is a single, elongated beam or rod. In an alternative embodiment (not shown), the base member may include a plurality of components.

In one embodiment, the outer rafter chord 610, the inner rafter chord 620, and the horizontal base chord 630 are constructed of steel and have I-beam configurations. In alternative embodiments, at least one of the outer rafter chord 610, the inner rafter chord 620, and the horizontal base chord 630 may be constructed of other metals, wood, a polymeric material, or other known construction materials. Further, in alternative embodiments, at least one of the outer rafter chord 610, the inner rafter chord 620, and the horizontal base chord 630 may have a cross-section that is L-shaped, C-shaped, T-shaped, square, rectangular, circular, oval, or any other regular or irregular polygonal shape.

The bottom of the horizontal base chord 630 is connected to the outer rafter chord 610 and the inner rafter chord 620 in a configuration substantially similar to the embodiment illustrated in FIGS. 2 and 3, resulting in a tapered truss. The angles between the components and their respective longitudinal axes (not shown) is substantially the same as described above with respect to FIG. 3. Additionally, the horizontal base chord 630 is configured to be connected to the top surface of a support member (not shown). The tapered configuration of the truss in combination with the placement of the truss on the top surface of support members results in a substantial reduction of a bending moment at the junction point and a corresponding reduction of right-left compression and horizontal reaction.

In one embodiment, the outer rafter chord 610 and the inner rafter chord 620 are joined by a first webbing, illustrated in FIG. 6 as a plurality of beams 640. The beams 640 are attached to the outer rafter chord 610 and inner rafter chord 620 to form a series of triangles and polygons. In one embodiment (not shown), the horizontal base chord 630 is also joined to the outer rafter chord 610 by beams. In the illustrated embodiment, the beams 640 are directly attached to the outer rafter chord 610 and inner rafter chord 620. The beams 640 may be welded or attached via fasteners. Exemplary fasteners include rivets, bolts, screws, nails, pins, and other known fasteners. In an alternative embodiment (not shown), the beams 640 are attached via junction plates, brace plates, or other known connectors.

In one embodiment, the beams 640 are constructed of steel and have a rectangular cross-section. In alternative embodiments, the beams 640 may be constructed of other metal, wood, a polymeric material, or other known construction materials. Further, in alternative embodiments, the beams 640 may have cross-sections that are I-shaped, L-shaped, C-shaped, T-shaped, square, circular, oval, or any other regular or irregular polygonal shape. In another alternative embodiment (not shown), the half truss portion 600 is solid and the outer rafter chord 610 and inner rafter chord 620 are joined by a solid sheet.

With continued reference to FIG. 6, the half truss portion 600 further includes a plurality of retainers 650 to receive purlins for attaching a roof deck 660. In an alternative embodiment (not shown), the half truss portion 600 does not include retainers and the roof deck 660 is attached directly to the outer rafter chord 610. In one embodiment, retainers 650 are configured such that they are spaced about 2 ft. apart, when measured from the center of a first retainer 650 to the center of an immediately adjacent retainer 650. In another embodiment, retainers 650 are configured such that they are spaced between 1 ft. and 4 ft. apart, when measured from the center of a first retainer 650 to the center of an immediately adjacent retainer 650. In yet another embodiment, retainers 650 are configured to receive purlins in the form of a dimensional 2 in. by 6 in. board. In still another embodiment, retainers 650 are configured to receive purlins in the form of a dimensional 2 in. by 4 in. board, or a dimensional 2 in. by 8 in. board.

In the illustrated embodiment, the half truss portion 600 further includes a vertical member 670 having a top end attached to the outer rafter chord 610. The vertical member 670 acts as a connection member and is configured to be attached to a vertical member of a complementary half truss portion (not shown). In the illustrated embodiment, the vertical member 670 is a single beam. In alternative embodiments (not shown), the vertical member includes multiple components.

The half truss portion 600 further includes a horizontal ceiling joist chord 680. The horizontal ceiling joist chord 680 is connected at a first end to the inner rafter chord 620 and is connected at a second end to a bottom end of the vertical member 670. In the illustrated embodiment, horizontal ceiling joist chord 680 is also joined to the outer rafter chord 610 via a second webbing defined by additional beams 690. In the illustrated embodiment, the horizontal ceiling joist chord 680 is a single beam. In alternative embodiments (not shown), the horizontal ceiling joist chord includes multiple components.

It should be understood that a complementary half portion (not shown) would include a second outer rafter chord, a second inner rafter chord, a second horizontal base chord, and a second horizontal ceiling joist chord, all substantially the same as the elements illustrated in the half truss portion 600 of FIG. 6. The second outer rafter chord would further include a third webbing defined by beams, joining the second outer rafter chord to the second inner rafter chord, substantially the same as the first webbing illustrated in FIG. 6.

FIGS. 7-17 illustrate exemplary alternative embodiments of tapered trusses. It should be understood that the alternative embodiments may be constructed of any of the materials described above in relation to FIGS. 1-6. It should also be understood that the components of the alternative embodiments may have any of the cross-sections described above in relation to FIGS. 1-6. It should be further understood that any beam, rafter, chord, or other such component that is illustrated as a single element may be replaced with multiple components.

Figure 7:
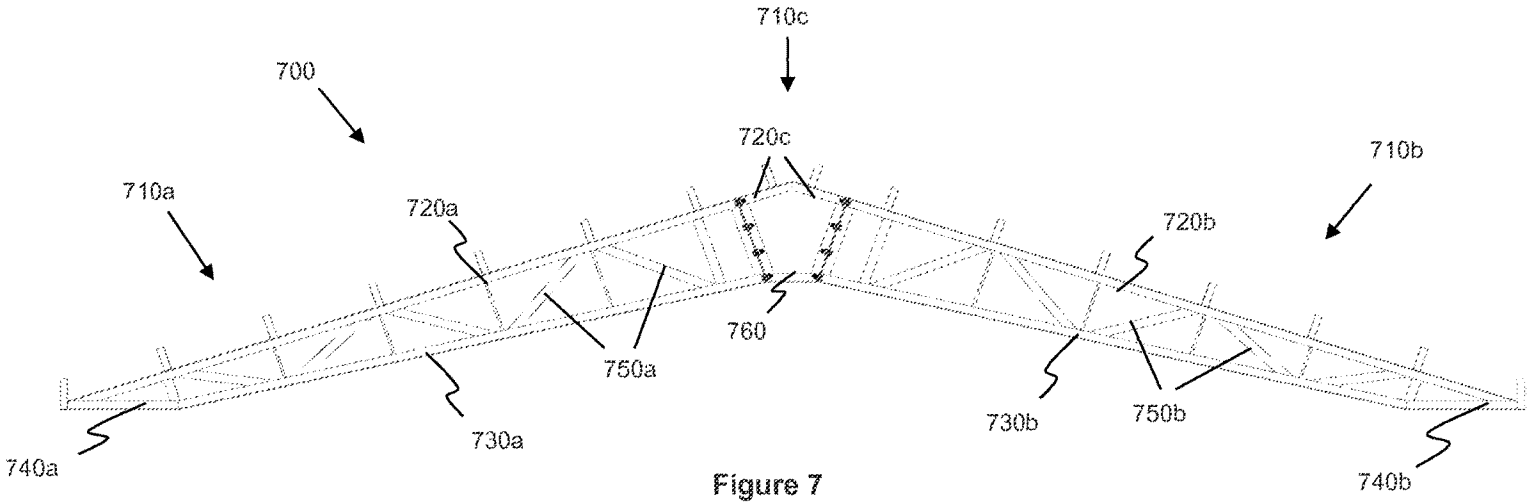
FIG. 7 illustrates a front view of an alternative embodiment of a tapered truss.

FIG. 7 illustrates a front view of an alternative embodiment of a tapered truss 700. In this embodiment, the tapered truss 700 includes a first truss portion 710*a* having a first outer rafter chord 720*a*, a first inner rafter chord 730*a*, a first horizontal base chord 740*a*, and a first webbing comprised of a plurality of beams 750*a*. The tapered truss 700 further includes a second truss portion 710*b* having a second outer rafter chord 720*b*, a second inner rafter chord 730*b*, a second horizontal base chord 740*b*, and a second webbing comprised of a plurality of beams 750*b*. The truss 700 is tapered as described above with respect to FIGS. 2 and 3. The truss 700 is constructed of materials similar to those described above in relation to FIGS. 2 and 3. In an alternative embodiment (not shown), the inner and outer rafters are joined by solid sheets instead of a webbing.

The truss 700 further includes a central truss portion 710*c* having a horizontal ceiling joist chord 750. The central truss portion 710*c* includes additional outer rafter chords 720*c* and is configured to be attached to the first and second truss portions 710*a,b* in a manner described above in relation to FIG. 5. The central truss portion 710*c* thereby forms a central ridge of the truss 700. In an alternative embodiment (not shown), the additional outer rafter chords 720*c* are joined with the horizontal ceiling joist chord 760 by a webbing. In another alternative embodiment (not shown), the additional outer rafters 720*c* are joined with the horizontal ceiling joist chord 760 by a solid sheet.

Figure 8:
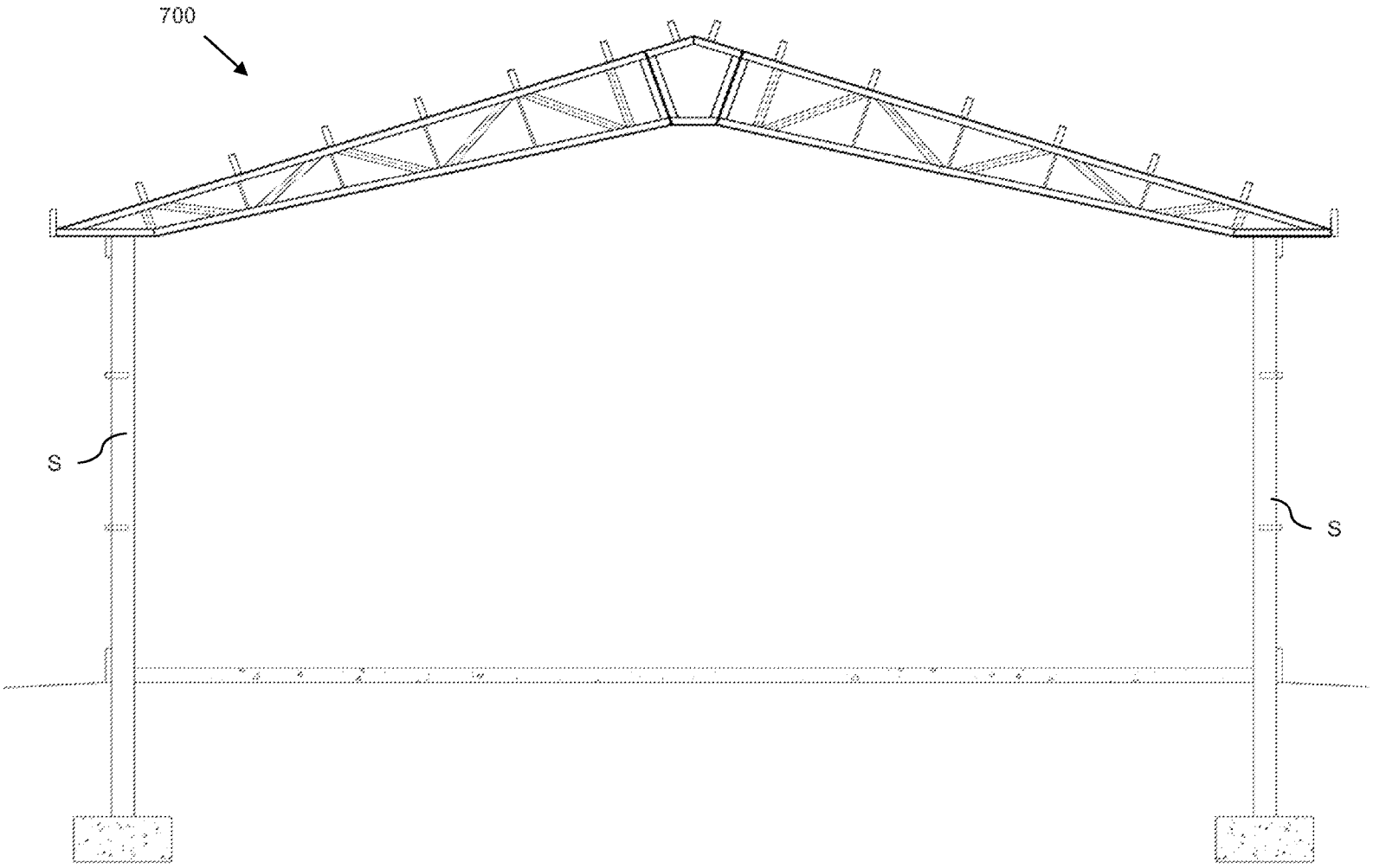
FIG. 8 illustrates a front view of an alternative embodiment of a tapered truss on support members.

FIG. 8 illustrates the truss 700 from FIG. 7 on support members S. The tapered configuration of the truss 700 in combination with its placement on the top surface of the support members S results in a substantial reduction of a bending moment at the junction point and a corresponding reduction of right-left compression and horizontal reaction.

Figure 9:
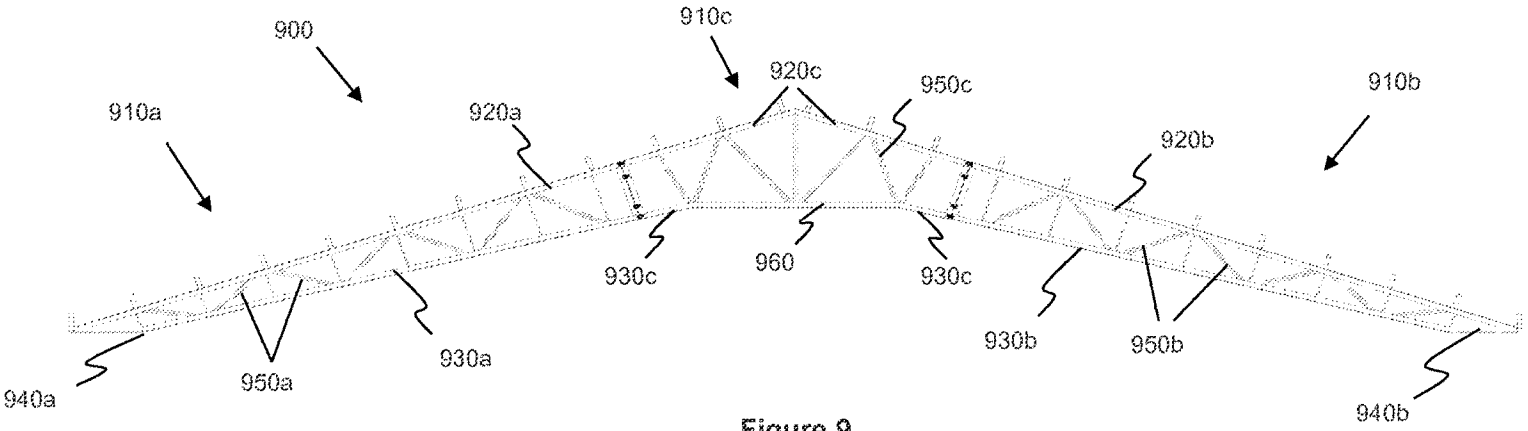
FIG. 9 illustrates a front view of another alternative embodiment of a tapered truss.

FIG. 9 illustrates a front view of another alternative embodiment of a tapered truss 900. In this embodiment, the tapered truss 900 includes a first truss portion 910*a* having a first outer rafter chord 920*a*, a first inner rafter chord 930*a*, a first horizontal base member 940*a*, and a first webbing comprised of a plurality of beams 950*a*. The tapered truss 900 further includes a second portion 910*b* having a second outer rafter chord 920*b*, a second inner rafter chord 930*b*, a second horizontal base member 940*b*, and a second webbing comprised of a plurality of beams 950*b*. The truss 900 is tapered as described above with respect to FIGS. 2 and 3. The truss 900 is constructed of materials similar to those described above in relation to FIGS. 2 and 3.

The truss 900 further includes a central truss portion 910*c* having a horizontal ceiling joist chord 960. The central truss portion 910*c* includes additional outer rafter chords 920*c*, additional inner rafter chords 930*c*, and a third webbing comprised of a plurality of beams 950*c*. The central truss portion 910*c* is configured to be attached to the first and second truss portions 910*a,b* in a manner described above in relation to FIG. 5. The central portion 910*c* thereby forms a central ridge of the truss 900.

Figure 10:
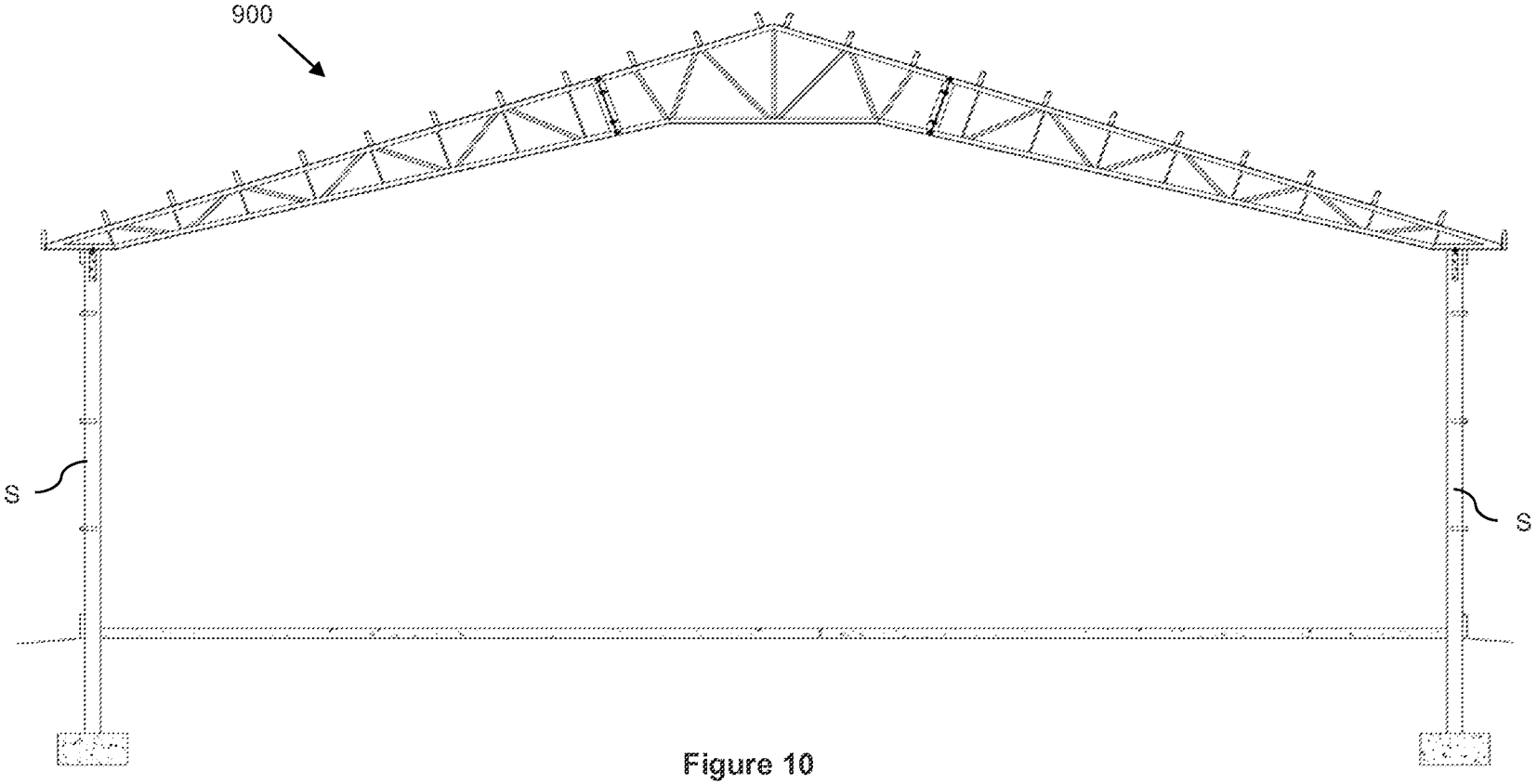
FIG. 10 illustrates a front view of another alternative embodiment of a tapered truss on support members.

FIG. 10 illustrates the truss 900 of FIG. 9 on support members S. The tapered configuration of the truss 900 in combination with its placement on the top surface of the support members S results in a substantial reduction of a bending moment at the junction point and a corresponding reduction of right-left compression and horizontal reaction.

Figure 11:
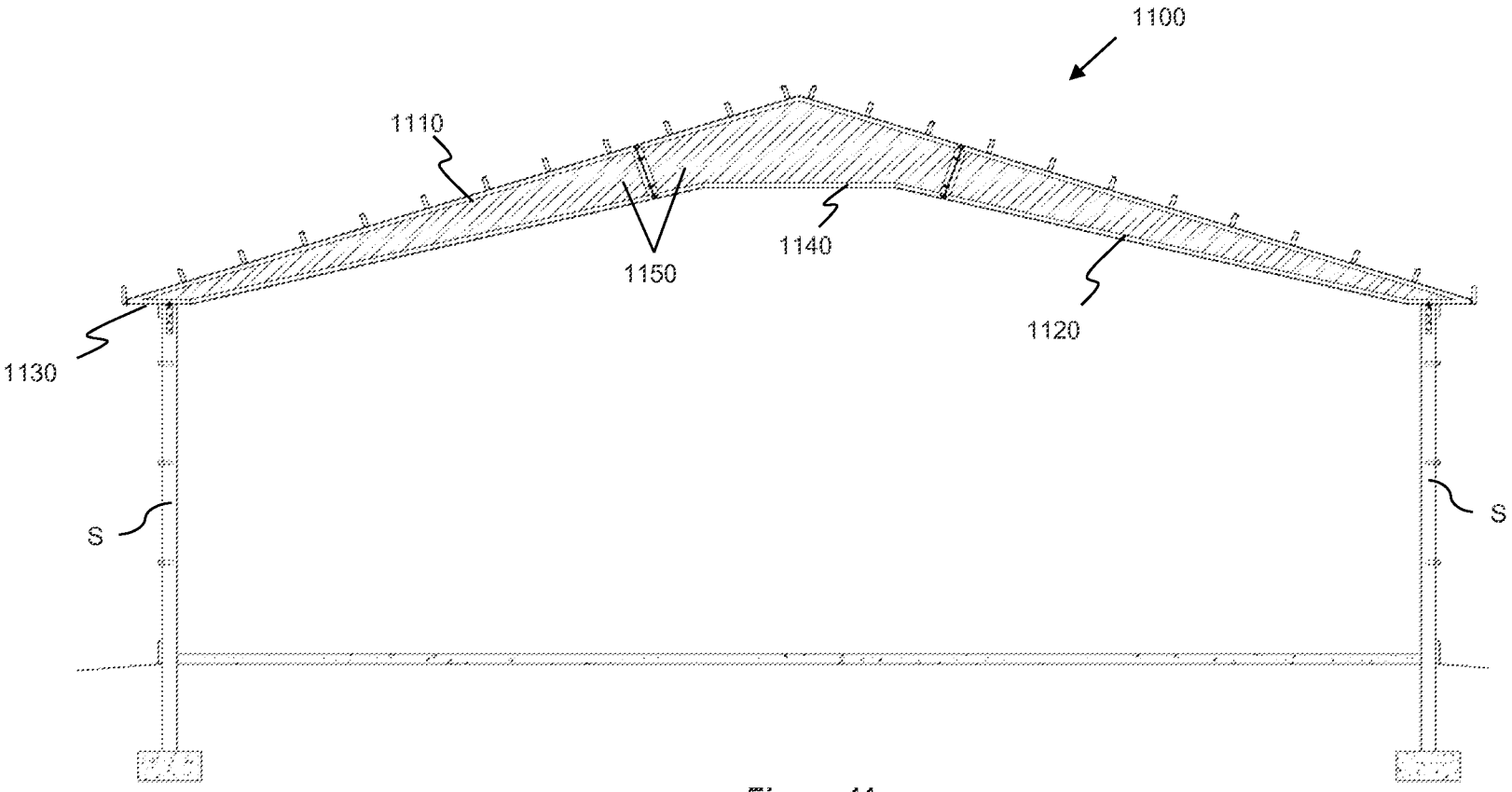
FIG. 11 illustrates a front view of a solid, tapered truss on support members.

FIG. 11 illustrates an alternative embodiment of a tapered truss 1100 on support members S. The truss 1100 is substantially similar to the tapered truss 900 shown in FIGS. 9 and 10, but it does not include webbing. Instead, the truss 1100 includes a plurality of outer rafter chords 1110, inner rafter chords 1120, horizontal base chords 1130, and a horizontal ceiling joist chord 1140 that are joined by solid steel sheets 1150. In an alternative embodiment, the chords may be joined by sheets constructed of other metals, wood, a polymeric material, or other known construction materials. In another alternative embodiment (not shown) some chords are joined by a webbing and others are joined by a solid sheet.

Figure 12:
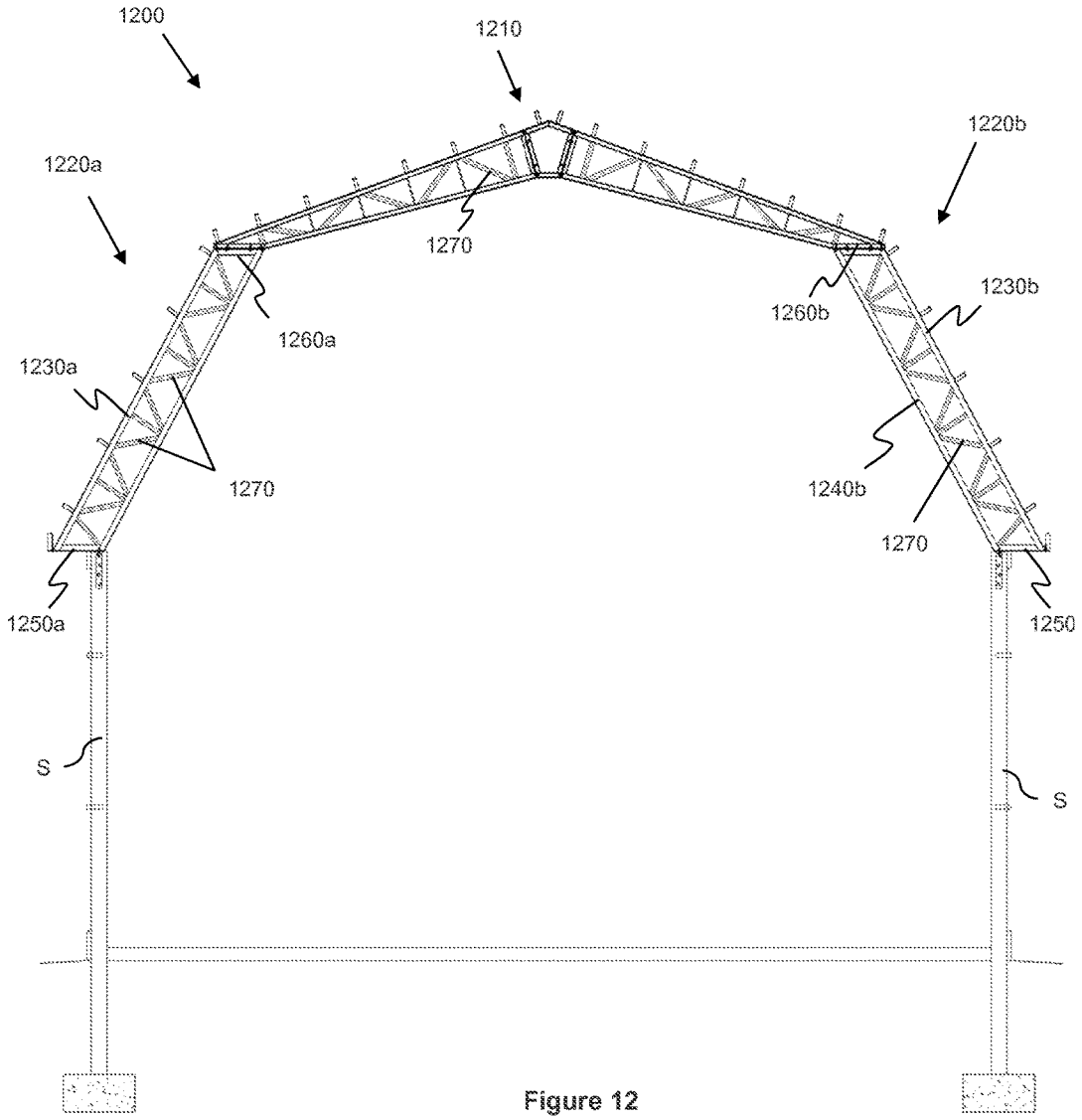
FIG. 12 illustrates a front view of a tapered gambrel truss.

FIG. 12 illustrates a front view of a tapered gambrel roof truss 1200 on support members S. A gambrel is commonly understood to be a roof having two slopes on each side. The upper slope is positioned at a shallower angle while the lower slope has a steeper angle. In the illustrated embodiment, the gambrel roof truss 1200 includes an upper tapered truss 1210 that defines the upper slopes of the gambrel. In this embodiment, the upper tapered truss 1210 is similar in design to the tapered truss 700 described above in relation to FIG. 7. It should be understood that the illustrated upper tapered truss 1210 is exemplary, and that any embodiment of a tapered truss described or suggested above may be employed.

With continued reference to FIG. 12, the lower slope is defined by first and second lower structures 1220*a,b*. The first lower structure 1220*a* includes an outer rafter chord 1230*a* and an inner rafter chord 1240*a*. The first lower structure further includes a horizontal base chord 1250*a* configured to be connected to the top surface of a support member S and a top horizontal chord 1260*a* configured to be attached to a horizontal base chord of the upper tapered truss 1210. In the illustrated embodiment, the outer rafter chord 1230*a* is substantially parallel to the inner rafter chord 1240*a*. In an alternative embodiment (not shown), the outer rafter chord 1230*a* may be disposed at an acute angle with respect to the inner rafter chord 1240*a*.

In the illustrated embodiment, the second lower structure 1220*b* includes an outer rafter chord 1230*b* and an inner rafter chord 1240*b*. The second lower structure further includes a horizontal base chord 1250*b* configured to be connected to the top surface of a support member S and a top horizontal chord 1260*b* configured to be attached to a horizontal base chord of the upper tapered truss 1210. In the illustrated embodiment, the outer rafter chord 1230*b* is substantially parallel to the inner rafter chord 1240*b*. In an alternative embodiment (not shown), the outer rafter chord 1230*b* may be disposed at an acute angle with respect to the inner rafter chord 1240*b*.

With continued reference to FIG. 12, the upper tapered truss 1210 and the first and second lower structures 1220*a,b* each include webbing configured to join the chords. In the illustrated embodiment, the webbing is comprised of a plurality of beams 1270. The beams 1270 may be attached to the chords using any of the attachment methods described above.

Figure 13:
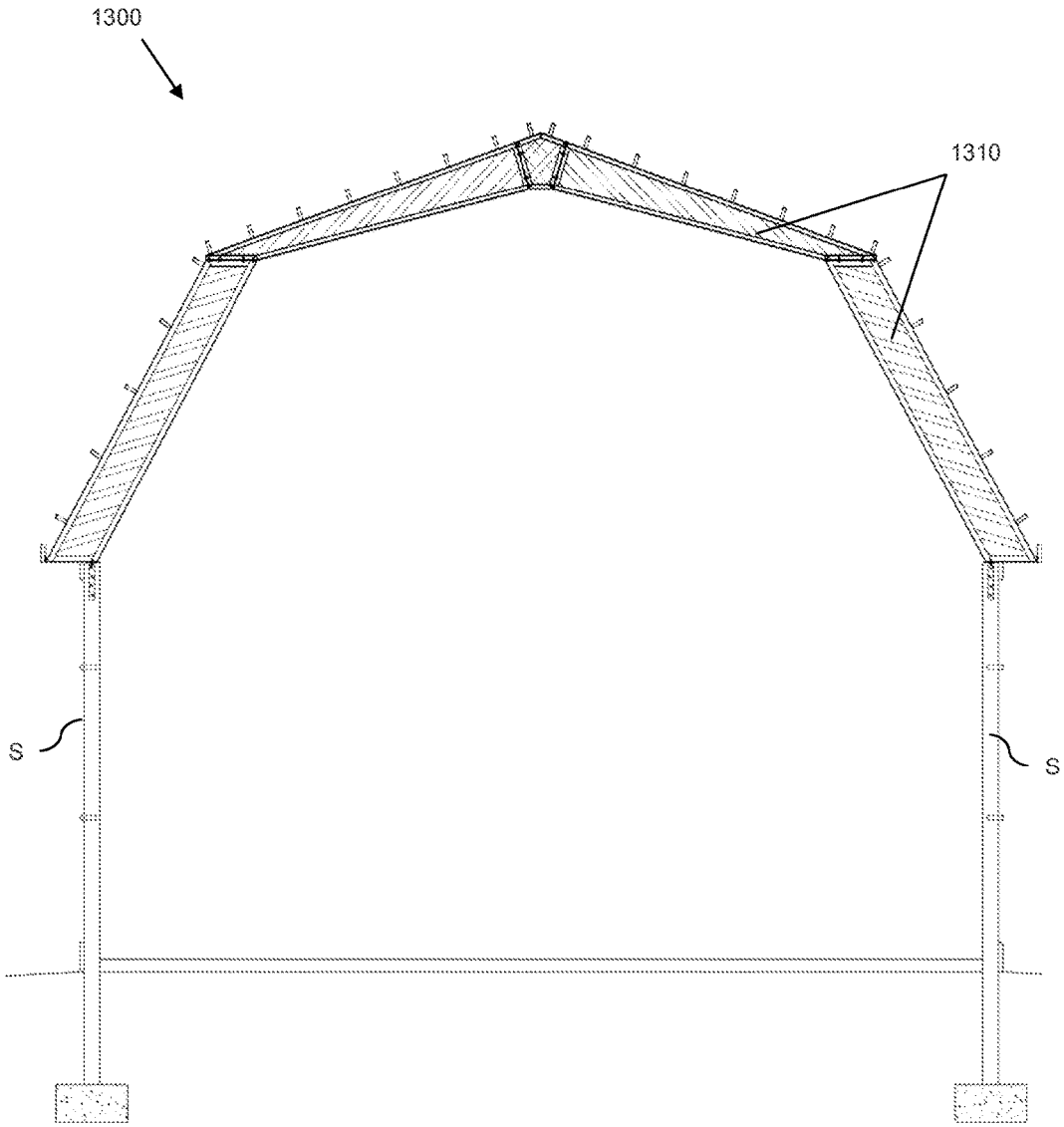
FIG. 13 illustrates a front view of a solid, tapered gambrel truss.

FIG. 13 illustrates an alternative embodiment of a tapered gambrel roof truss 1300 on support members S. The tapered gambrel roof truss 1300 is substantially similar to the tapered gambrel roof truss 1200 shown in FIG. 12, but it does not include webbing. Instead, the tapered gambrel roof truss 1300 includes a plurality of chords that are joined by solid steel sheets 1310. In an alternative embodiment, the chords may be joined by sheets constructed of other metal, wood, a polymeric material, or other known construction material. In another alternative embodiment (not shown) some chords are joined by a webbing and others are joined by a solid sheet.

Figure 14:
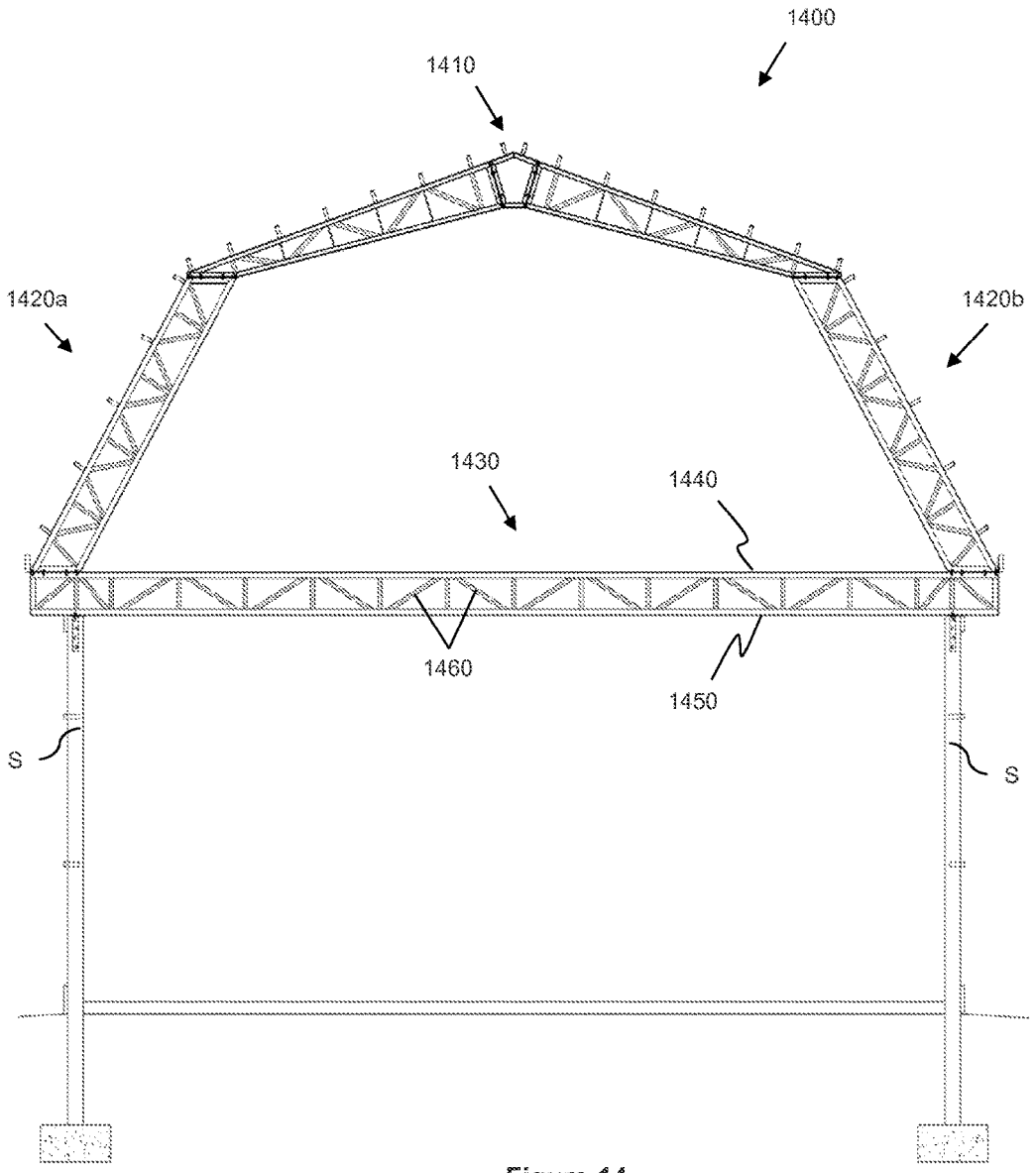
FIG. 14 illustrates a front view of a tapered gambrel truss having a lofted floor.

FIG. 14 illustrates an alternative embodiment of a tapered gambrel roof truss 1400 on support members S. In this embodiment, the tapered gambrel roof truss 1400 is substantially the same as the tapered gambrel roof truss 1200 illustrated in FIG. 12 and includes an upper tapered truss 1410 and first and second lower structures 1420*a,b* that are substantially the same as the corresponding components described above in relation to FIG. 12. The tapered gambrel roof truss 1400 further includes a floor structure 1430 disposed between the support members S and first and second lower structures 1420*a,b*. In the illustrated embodiment, the floor structure 1430 includes upper rafter chords 1440 and lower rafter chords 1450. In the illustrated embodiment, the upper rafter chords 1440 are substantially horizontal and substantially parallel to the lower rafter chords 1450. In an alternative embodiment (not shown), at least one of the upper rafter chords 1440 and the lower rafter chords 1450 may be sloped. In another alternative embodiment (not shown), the upper rafter chords 1440 may be disposed at an acute angle with respect to the lower rafter chords 1450.

With continued reference to FIG. 14, the floor structure 1430 further includes webbing configured to join the upper rafter chords 1440 and lower rafter chords 1450. In the illustrated embodiment, the webbing is comprised of beams 1460. The beams 1460 may be attached to the chords using any of the attachment methods described above.

Figure 15:
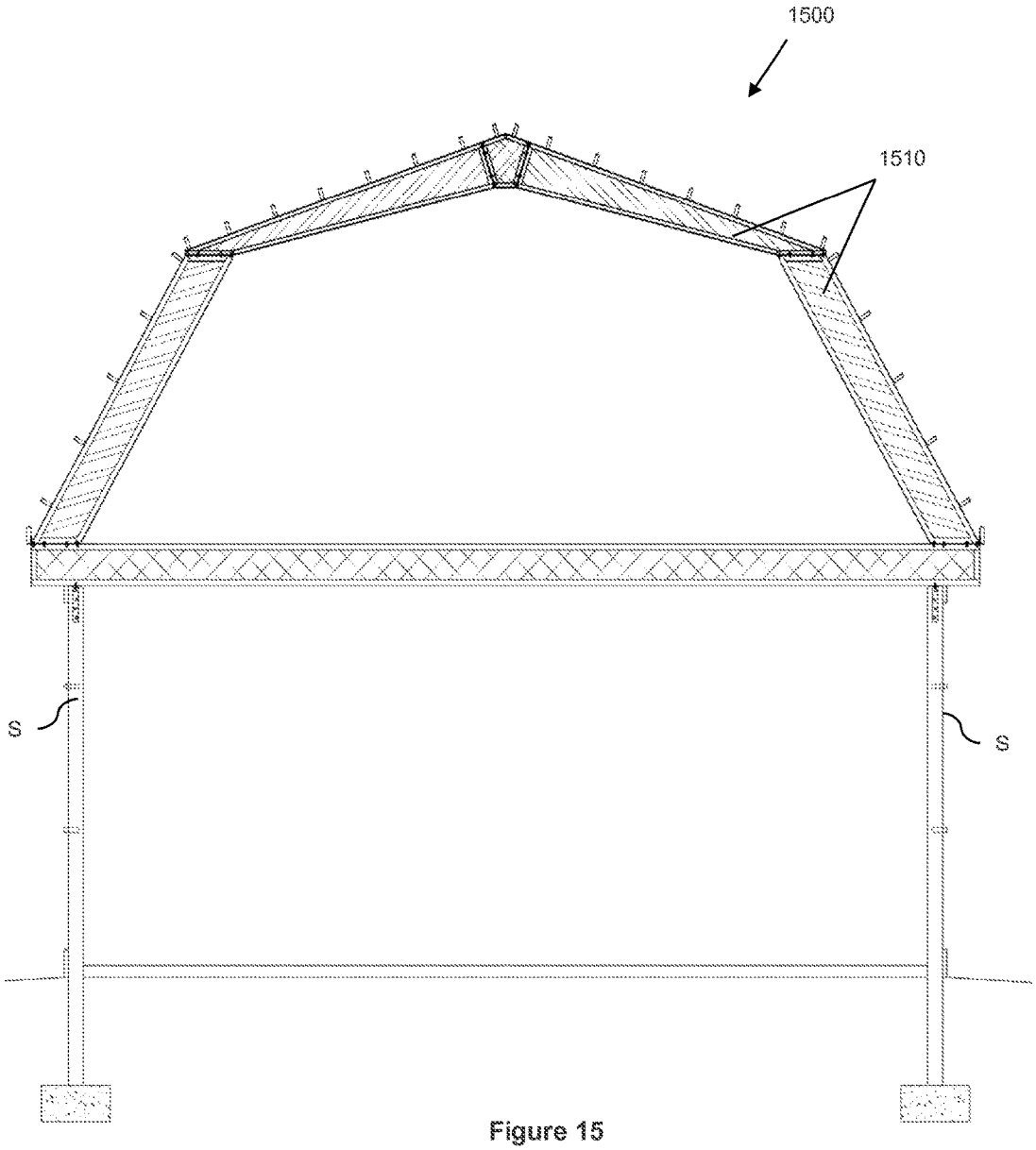
FIG. 15 illustrates a front view of a solid, tapered gambrel truss having a lofted floor.

FIG. 15 illustrates an alternative embodiment of a tapered gambrel roof truss 1500 on support members S. The tapered gambrel roof truss 1500 is substantially similar to the tapered gambrel roof truss 1400 shown in FIG. 14, but it does not include webbing. Instead, the tapered gambrel roof truss 1500 includes a plurality of chords that are joined by solid steel sheets 1510. In an alternative embodiment, the chords may be joined by sheets constructed of other metal, wood, a polymeric material, or other known construction materials. In another alternative embodiment (not shown) some chords are joined by a webbing and others are joined by a solid sheet.

Figure 16:
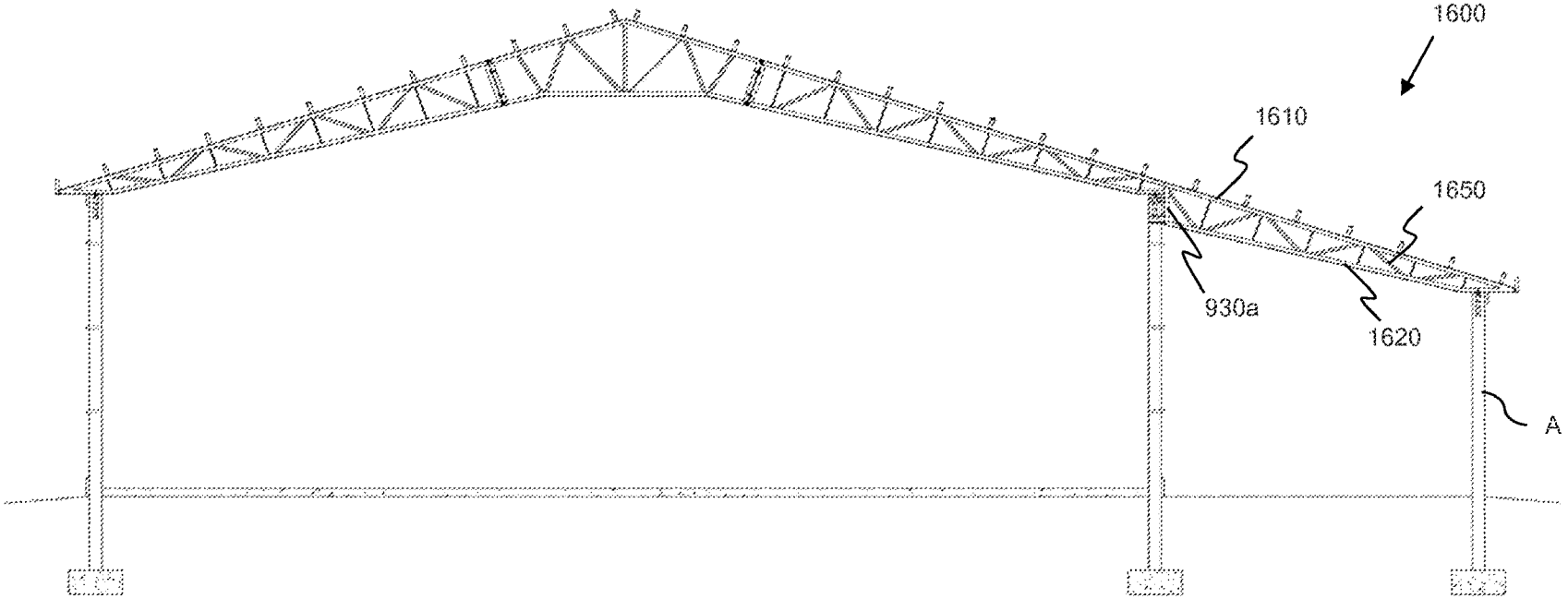
FIG. 16 illustrates a front view of a tapered lean-to truss.

FIG. 16 illustrates a tapered lean-to truss 1600 on auxiliary support members A and abutting a structure. In the illustrated embodiment, the lean-to truss 1600 abuts a structure substantially the same as the tapered truss 900 resting on support members S illustrated in FIG. 10. It should be understood that the lean-to truss 1600 may abut any known structure.

In the illustrated embodiment, the tapered lean-to truss 1600 includes an outer rafter chord 1610, an inner rafter chord 1620, a horizontal base chord 1630, and a vertical end chord 1640. The vertical end chord 1640 is connected to the outer rafter chord 1610 and the inner rafter chord 1620 and is configured to be attached to a structure by any of the above described attachment methods. The horizontal base chord 1630 is connected to the outer rafter chord 1610 and the inner rafter chord 1620 in a manner similar to that described above in relation to FIG. 3. The horizontal base chord 1630 is further configured to be attached to a top surface of an auxiliary support member A by any of the above described attachment methods.

With continued reference to FIG. 16, the tapered lean-to truss 1600 further includes webbing joining the outer rafter chord 1610 and the inner rafter chord 1620. The webbing may also join the inner and outer rafter chords 1610, 1620 to the horizontal base chord and the vertical chord. In the illustrated embodiment, the webbing is comprised of beams 1650. The beams 1650 may be attached to the chords using any of the attachment methods described above.

Figure 17:
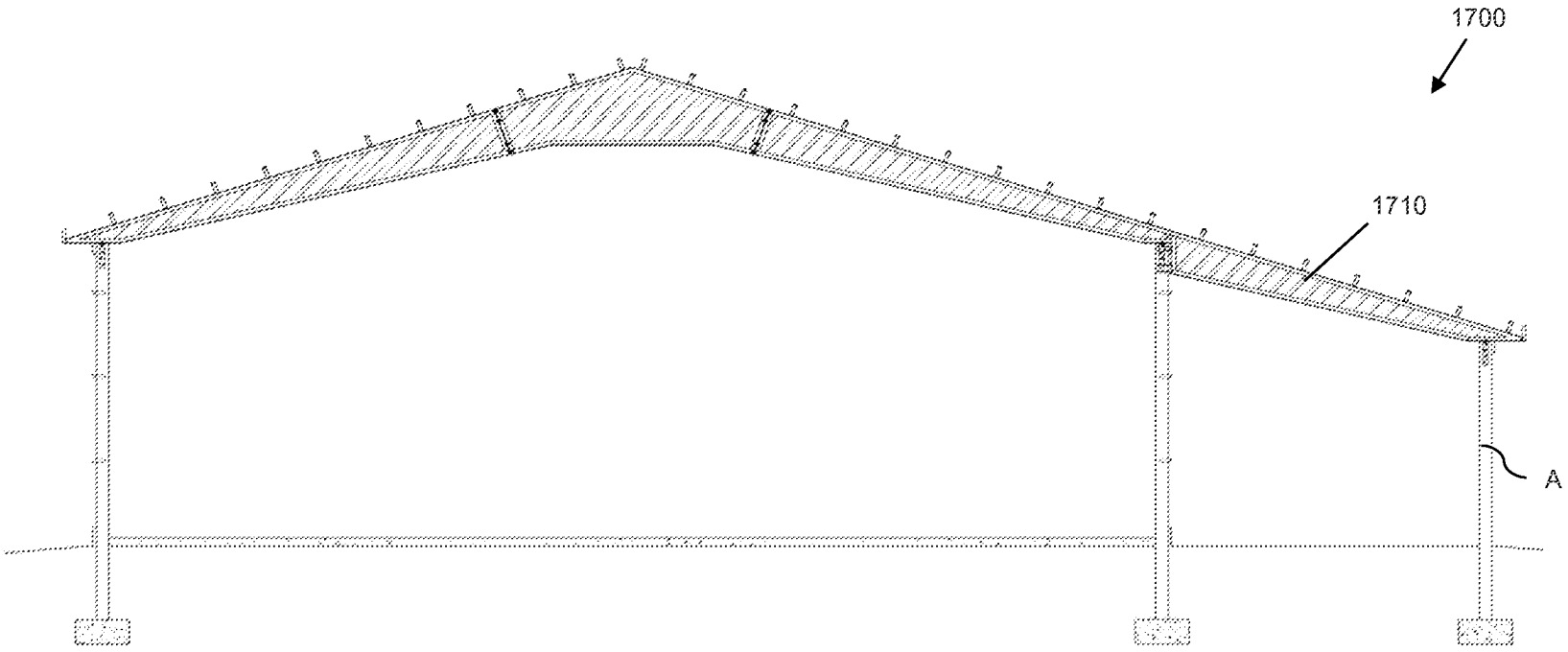
FIG. 17 illustrates a front view of a solid, tapered lean-to truss.

FIG. 17 illustrates an alternative embodiment of a tapered lean-to roof truss 1700 on auxiliary support members A. The tapered lean-to roof truss 1700 is substantially similar to the tapered lean-to roof truss 1600 shown in FIG. 16, but it does not include webbing. Instead, the tapered lean-to roof truss 1700 includes a plurality of chords that are joined by solid steel sheets 1710. In an alternative embodiment, the chords may be joined by sheets constructed of other metal, wood, a polymeric material, or other known construction materials. In the illustrated embodiment, the tapered lean-to roof truss 1700 abuts a structure having a tapered truss with rafters joined by a solid sheet. However, it should be understood that the tapered lean-to roof truss 1700 may abut any structure, including structures employing a tapered truss with rafters joined by webbing.

FIG. 18 illustrates a perspective view of an eave portion of a tapered truss 1800 that defines an end wall of a structure. The tapered truss 1800 includes an outer rafter chord 1810 and an inner rafter chord 1820. As described above in relation to FIG. 1, a tapered truss defining an end wall may be attached to a side surface of a support member that further defines the end wall. In the embodiment illustrated in FIG. 18, the tapered truss 1800 is attached to a corner support member C by a truss tie 1830. In the illustrated embodiment, the truss tie 1830 is contoured such that an upper portion 1830*a* is configured to lie flat against and be attached to the outer rafter 1810, a lower portion 1830*b* is configured to lie flat against and be attached to the inner rafter 1820 and a central portion 1830*c* is configured to lie flat against and be attached to the corner support member C. In the illustrated embodiment, the upper portion 1830*a* of the truss tie 1830 is welded to the outer rafter 1810, the lower portion 1830*b* of the truss tie 1830 is welded to the inner rafter 1820, and the central portion 1830*c* of the truss tie 1810 is bolted to the side of the corner support member C. However, it should be understood that any combination of the above described methods of attachment may be used.

FIG. 19 illustrates a perspective view of a tapered truss 1900 that defines an end wall of a structure, at a location spaced away from the eave. The tapered truss 1900 includes an outer rafter 1910 and an inner rafter 1920. In the illustrated embodiment, the tapered truss 1900 is attached to a support member S by an upper truss tie 1930 and a lower truss tie 1940. The upper truss tie 1930 is contoured such that an upper portion 1930*a* is configured to lie flat against and be attached to the outer rafter 1910 and a lower portion 1930*b* is configured to lie flat against and be attached to the support member S. In the illustrated embodiment, the upper portion 1930*a* of the upper truss tie 1930 is welded to the outer rafter 1910 and the lower portion 1930*b* of the upper truss tie 1930 is bolted to the side of the support member S. However, it should be understood that any combination of the above described methods of attachment may be used.

With continued reference to FIG. 19, the lower truss tie 1940 is contoured such that a lower portion 1940*a* is configured to lie flat against and be attached to the inner rafter 1920 and an upper portion 1940*b* is configured to lie flat against and be attached to the support member S. In the illustrated embodiment, the lower portion 1940*a* of the lower truss tie 1940 is welded to the inner rafter 1920 and the upper portion 1940*b* of the upper truss tie 1940 is bolted to the side of the support member S. However, it should be understood that any combination of the above described methods of attachment may be used.

Figure 20:
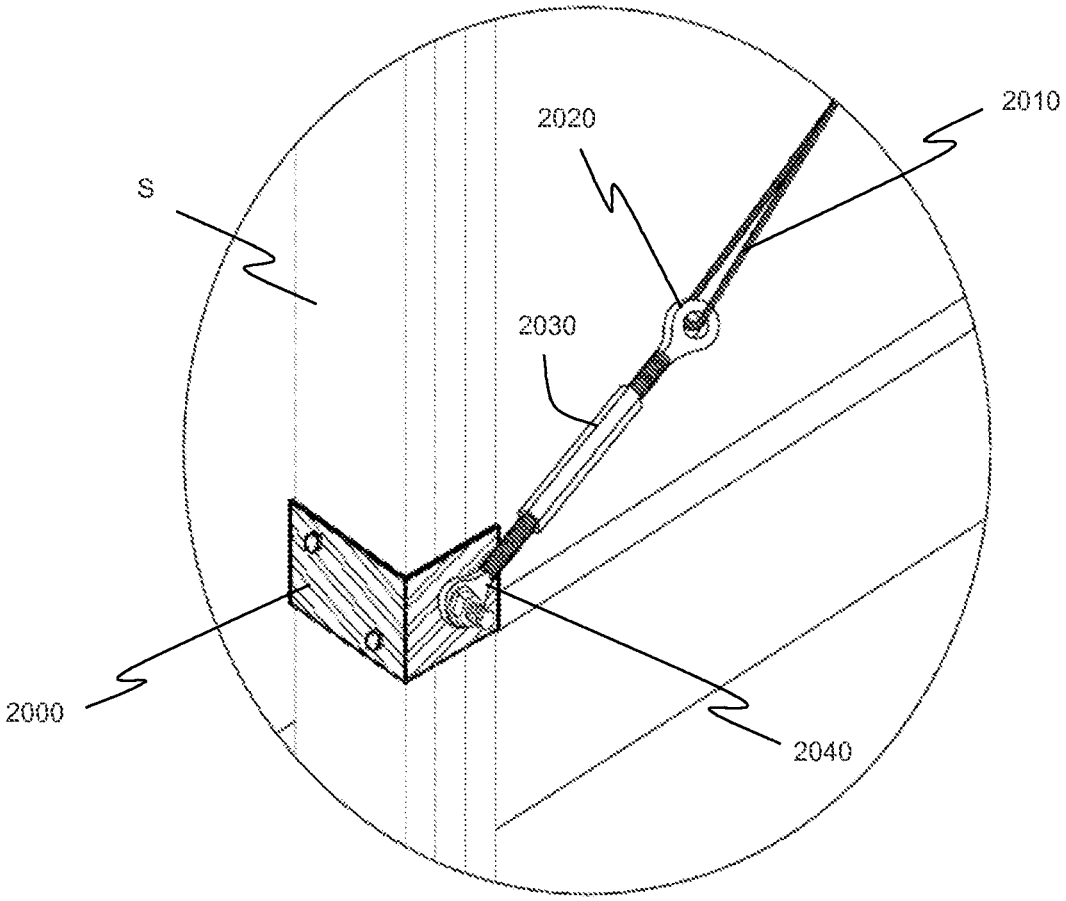
FIG. 20 illustrates a perspective view of a lower bracket and connection for bracing a wall.

FIG. 20 illustrates a lower connection for an X-brace, such as the X-brace 120 illustrated in FIG. 1. In FIG. 20, an L-shaped bracket 2000 is attached to a support member S. In the illustrated embodiment, the L-shaped bracket 2000 is bolted to the support member S. However, it should be understood that any combination of the above described methods of attachment may be used.

In the illustrated embodiment, the X-brace is defined by a cable 2010. The cable 2010 is attached to a first eyelet screw 2020, which is inserted into a first end of a threaded tube 2030. A second eyelet screw 2040 is inserted into a second end of the threaded tube 2030. The second eyelet screw is then bolted to the bracket 2000 and the support member S. In an alternative embodiment (not shown), the bracket is a flat bracket instead of L-shaped.

Figure 21:
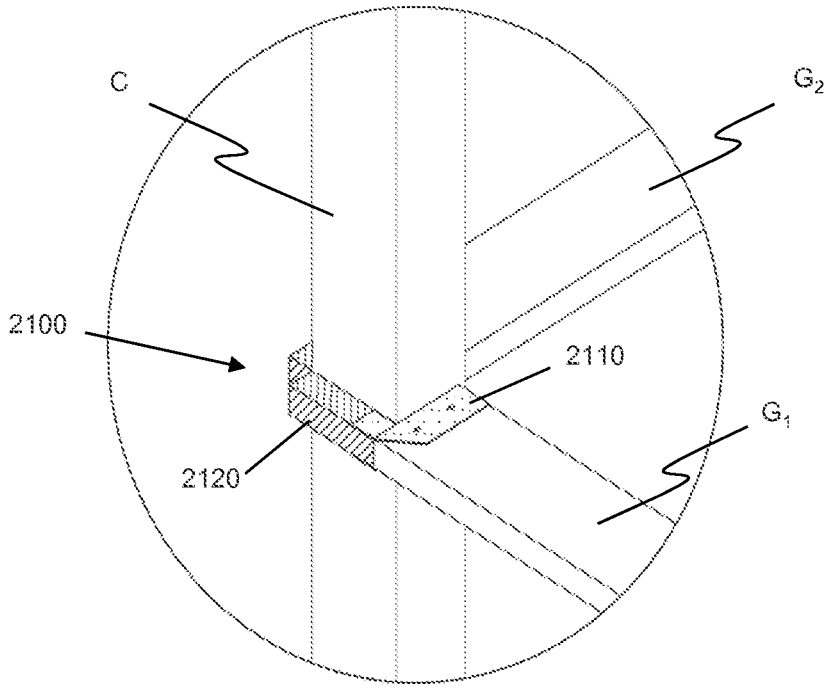
FIG. 21 illustrates one embodiment of a girt retaining assembly.

FIG. 21 illustrates a first girt retaining assembly 2100 for attaching a first girt $G_1$ to a corner support member C. In the illustrated embodiment, the first girt retaining assembly 2100 includes a first bracket 2110 and a second bracket (not show), each configured to be attached to the first girt $G_1$. The first and second brackets are further configured to be attached to a connecting member 2120, shown here as a block. The connecting member 2120 is configured to be attached to the corner support member C. In one embodiment, the first and second brackets are part of a unitary clip. In another embodiment, the first and second brackets are separate components.

As can be seen in the illustrated embodiment, the first girt retaining assembly 2100 is aligned with the corner support member C such that the first girt $G_1$ is substantially perpendicular to the corner support member C and is substantially parallel to the ground. In alternative embodiments, the girt retaining assembly 2100 may be attached to the support member S at any desired angle.

With continued reference to FIG. 21, a second girt retaining assembly is hidden from view. The second girt retaining assembly is substantially the same as the girt retaining assembly 2100 described above, and is attached to the corner support member C such that a second girt $G_2$ is aligned substantially perpendicularly to the corner support member C and is also aligned substantially perpendicularly to the girt $G_1$ held by the girt retaining assembly 2100.

Figure 22:
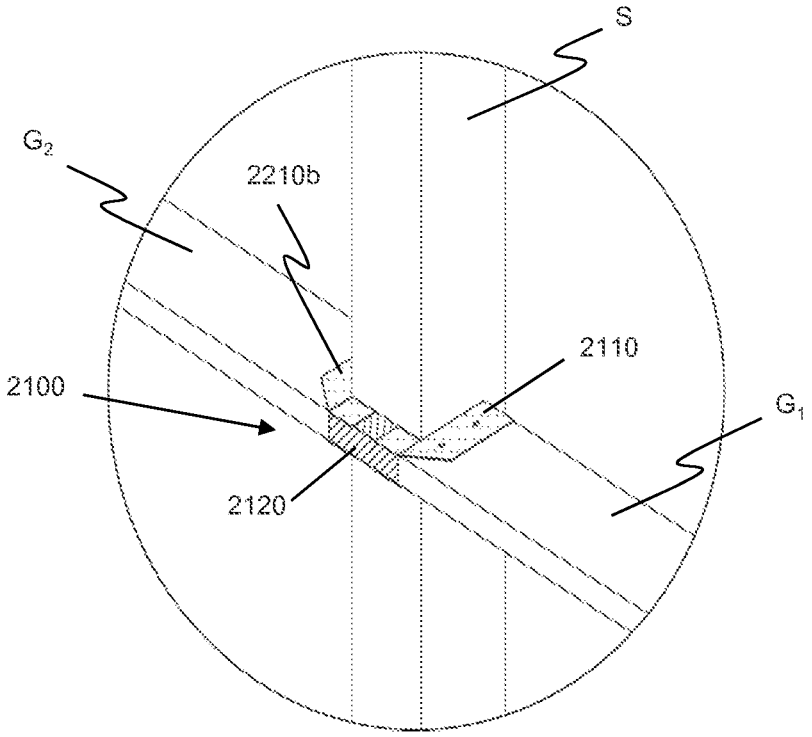
FIG. 22 illustrates an alternative embodiment of a girt retaining assembly.

FIG. 22 illustrates an alternative embodiment of a girt retaining assembly 2200 for attaching a pair of girts $G_1$, $G_2$ to a support member S. In the illustrated embodiment, the girt retaining assembly 2200 includes first and second upper brackets 2210*a,b* and first and second lower brackets (not show), each configured to be attached to a connecting member 2220, shown here as a block. The connecting member 2220 is configured to be attached to the support member S. The first upper bracket and the first lower bracket are configured to retain a first girt $G_1$ and the second upper and second lower bracket are configured to retain a second girt $G_2$. In one embodiment, the first upper lower brackets are part of a first unitary clip and the second upper and lower brackets are part of a second unitary clip. In another embodiment, the each bracket is a separate component.

As can be seen in the illustrated embodiment, the girt retaining assembly 2200 is aligned with the support member S such that the first and second girts $G_1$, $G_2$ are each substantially perpendicular to the support member S and substantially parallel to the ground. Further, as can be seen in the illustrated embodiment, the first girt $G_1$ is substantially collinear with the second girt $G_2$. In alternative embodiments, the girt retaining assembly 2200 may be attached to the support member S at any desired angle.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the application, in its broader aspects, is not limited to the specific details, the representative apparatus, and illustrative examples shown and described. Accordingly, departures may be made from such details without departing from the spirit or scope of the applicant's claimed invention.

The invention claimed is:

1. A roof truss and support structure comprising:

a pair of first vertical support members adjacent to one another;

a pair of second vertical support members adjacent to one another in positions opposite the first vertical support members; and a pair of tapered truss structures, each of which has a length reaching from a first vertical support member to a second vertical support member without intermediary support, and each of which comprises:

a pair of base members, each base member having a bottom surface attached to a top surface of a respective vertical support member;

a pair of upper truss members, each upper truss member having a longitudinal axis extending from a respective base member at an acute angle;

a pair of lower truss members, each lower truss member having a longitudinal axis extending from a respective base member at an acute angle less than the acute angle of each of the upper truss members; and a horizontal ceiling joist member having a first end connected to a first of the pair of lower truss members and a second end connected to a second of the pair of lower truss members;

wherein the base members, the truss members, and the ceiling joist member are constructed of steel;

wherein the vertical support members are constructed of wood; and wherein the adjacent vertical support members are spaced apart from one another between approximately 10 ft. and approximately 20 ft.

2. The roof truss and support structure of claim 1, wherein each of the pair of tapered truss structures further comprises a central vertical member, each central vertical member having a top portion connected to a respective upper truss member and a bottom portion connected to the ceiling joist member.

3. The roof truss and support structure of claim 2, wherein the central vertical members are removably attached to each other.

4. The roof truss and support structure of claim 1, further comprising a plurality of retainers attached to the upper truss members and configured to receive purlins.

5. The roof truss and support structure of claim 1, wherein the length of each of the pair of truss structures reaching from the respective first vertical support member to the respective second vertical support member is between about 20 ft. and about 150 ft.

6. The roof truss and support structure of claim 1, wherein each of the pair of tapered truss structures further comprises a connecting web extending transversely between the respective upper truss members and the respective lower truss members, wherein the web comprises a beam having a L-shaped cross-section.

7. The roof truss and support structure of claim 1, wherein each of the pair of tapered truss structures further comprises a solid sheet extending between the respective upper truss members and the respective lower truss members.

8. A roof truss and support structure comprising:

a pair of first vertical support members adjacent to one another;

a pair of second vertical support members adjacent to one another in positions opposite the first vertical support members; and a pair of tapered truss structures, each of which has a length reaching from a first vertical support member to a second vertical support member without intermediary support, and each of which comprises:

a plurality of outer rafter chords, including a first outer rafter chord having a first slope and a second outer rafter chord having a second slope, defining a roof contour from eave to eave with respective first and second sloping sides leading from the eaves to a ridge;

a plurality of inner rafter chords, including a first inner rafter chord having a third slope and a second inner rafter chord having a fourth slope, wherein the third slope is less than the first slope and the second slope and the fourth slope is less than the first slope and the second slope;

a first webbing rigidly joining the first inner rafter chord with the first outer rafter chord, wherein the first webbing comprises a plurality of beams;

a second webbing rigidly joining the second inner rafter chord with the second outer rafter chord, wherein the second webbing comprises a plurality of beams;

a horizontal ceiling joist chord joining an upper end of the first inner rafter chord with an upper end of the second inner rafter chord;

a third webbing rigidly joining the horizontal ceiling joist chord with the first and second outer rafter chords, wherein the third webbing comprises a plurality of beams; and a plurality of horizontal base chords, each of which has a bottom surface attached to a top surface of a respective vertical support member, including a first horizontal base chord joined to the first outer rafter chord and the first inner rafter chord, and a second horizontal base chord joined to the second outer rafter chord and the second inner rafter chord;

wherein the truss structures are constructed of steel, wherein the vertical support members are constructed of wood, and wherein the adjacent vertical support members are spaced apart from one another between approximately 10 ft. and approximately 20 ft.

9. The truss and support structure of claim 8, wherein the horizontal ceiling joist chord includes a first portion joined to the upper end of the first inner rafter chord and a second portion joined to the upper end of the second inner rafter chord.

10. The roof truss and support structure of claim 9, further comprising a first vertical chord joined to the first portion of the horizontal ceiling joist chord and a second vertical chord being joined to the second portion of the horizontal ceiling joist chord.

11. The roof truss and support structure of claim 10, wherein the first vertical chord is removably attached to the second vertical chord.

12. The roof truss and support structure of claim 8, wherein the length of each of the pair of tapered truss structures reaching from the respective first vertical support member to the respective second vertical support member is between about 20 ft. and about 150 ft.

13. A roof truss and support structure comprising:

a pair of first vertical support members adjacent to one another;

a pair of second vertical support members adjacent to one another in positions opposite the first vertical support members; and a pair of tapered truss structures, each of which has a length reaching from a first vertical support member to a second vertical support member without intermediary support, and each of which comprises:

a pair of base members, each base member having a bottom surface attached to a top surface of a respective vertical support member;

a pair of upper truss members, each upper truss member having a longitudinal axis extending from a respective base member at an acute angle;

a pair of lower truss members, each lower truss member having a longitudinal axis extending from a respective base member at an acute angle less than the acute angle of each of the upper truss members; and wherein the base members and the truss members are constructed of steel;

wherein the vertical support members are constructed of wood; and wherein the adjacent vertical support members are spaced apart from one another between approximately 10 ft. and approximately 20 ft.

14. The roof truss and support structure of claim 13, further comprising a horizontal ceiling joist member having a first end connected to a first of the pair of lower truss members and a second end connected to a second of the pair of lower truss members.

15. The roof truss and support structure of claim 14, wherein each of the pair of tapered truss structures further comprises a central vertical member, each central vertical member having a top portion connected to a respective upper truss member and a bottom portion connected to the ceiling joist member.

16. The roof truss and support structure of claim 15, wherein the central vertical members are removably attached to each other.

17. The roof truss and support structure of claim 13, wherein each of the pair of tapered truss structures further comprises a central vertical member, each central vertical member having a top portion connected to a respective upper truss member and a bottom portion connected to a respective lower truss member.

18. The roof truss and support structure of claim 13, wherein the length of each of the pair of truss structures reaching from the respective first vertical support member to the respective second vertical support member is between about 20 ft. and about 150 ft.

19. The roof truss and support structure of claim 13, wherein each of the pair of tapered truss structures further comprises a connecting web extending transversely between the respective upper truss members and the respective lower truss members, wherein the web comprises a beam having a L-shaped cross-section.

20. The roof truss and support structure of claim 13, wherein each of the pair of tapered truss structures further comprises a solid sheet extending between the respective upper truss members and the respective lower truss members.

* * * * *